US012790906B2

(12) United States Patent
Saponja et al.

(10) Patent No.: US 12,790,906 B2
(45) Date of Patent: Nov. 10, 2026

(54) DOWNHOLE ANCHORING ASSEMBLY

(71) Applicant: Oilify New-tech Solutions Inc., Invermere (CA)

(72) Inventors: Jeffrey Charles Saponja, Invermere (CA); Robbie Singh Hari, Calgary (CA)

(73) Assignee: OILIFY NEW-TECH SOLUTIONS INC., Invermere (CA)

( * ) Notice: Subject to any disclaimer, the term of this patent is extended or adjusted under 35 U.S.C. 154(b) by 151 days.

(21) Appl. No.: 18/629,862

(22) Filed: Apr. 8, 2024

(65) Prior Publication Data

US 2024/0344414 A1 Oct. 17, 2024

Related U.S. Application Data

(60) Provisional application No. 63/595,304, filed on Nov. 1, 2023, provisional application No. 63/496,943, filed on Apr. 18, 2023, provisional application No. 63/494,655, filed on Apr. 6, 2023.

(51) Int. Cl.
*E21B 23/01* (2006.01)
*E21B 17/02* (2006.01)

(52) U.S. Cl.
CPC ..... *E21B 23/01* (2013.01); *E21B 17/026* (2013.01)

(58) Field of Classification Search
CPC ..... E21B 23/01; E21B 23/00; E21B 23/03; E21B 34/14; E21B 33/12; E21B 23/06; E21B 23/006
See application file for complete search history.

(56) References Cited

U.S. PATENT DOCUMENTS

| | | | | |
|---|---|---|---|---|
| 1,900,371 | A | 3/1933 | Smith | |
| 2,327,963 | A | 8/1943 | Haas | |
| 2,765,855 | A * | 10/1956 | Reed | E21B 23/01 166/215 |
| 3,292,708 | A * | 12/1966 | Mundt | E21B 17/1078 166/173 |
| 3,664,417 | A | 5/1972 | Conrad | |
| 4,369,840 | A * | 1/1983 | Szarka | E21B 23/006 166/216 |
| 4,901,793 | A * | 2/1990 | Weber | E21B 23/01 166/241.1 |
| 5,327,975 | A | 7/1994 | Land | |
| 6,796,380 | B2 | 9/2004 | Xu | |
| 9,157,289 | B1 | 10/2015 | Bair et al. | |
| 9,169,703 | B2 | 10/2015 | Larsen et al. | |
| 10,450,816 | B2 | 10/2019 | Bringham | |
| 11,220,881 | B2 | 1/2022 | Zachry et al. | |
| 11,649,687 | B1 | 5/2023 | Dawson | |
| 2010/0101779 | A1 * | 4/2010 | Obrejanu | E21B 23/01 166/216 |

(Continued)

OTHER PUBLICATIONS

Technical Specification Sheet, Black Gold Hydraulic Anchor, https://www.blackgoldpump.com/hydraulic-tubing-1 anchors, accessed Jul. 7, 2023.

*Primary Examiner* — Daniel P Stephenson

(57) ABSTRACT

There is provided an anchoring assembly configured for coupling to a production string that is emplaceable within a wellbore that is lined with casing. The anchoring assembly is transitionable from an anchoring Ineffective state to the anchoring effective state for effecting anchoring of the production string to the casing.

15 Claims, 20 Drawing Sheets

(56) References Cited

U.S. PATENT DOCUMENTS

| | | | | |
|---|---|---|---|---|
| 2015/0259998 | A1* | 9/2015 | Moore | E21B 40/001 166/382 |
| 2017/0350204 | A1* | 12/2017 | Moore | E21B 17/023 |
| 2021/0010339 | A1 | 1/2021 | Scruggs | |
| 2022/0397019 | A1 | 12/2022 | Frost et al. | |
| 2023/0399903 | A1 | 12/2023 | Stachowiak, Jr. | |
| 2024/0344414 | A1* | 10/2024 | Saponja | E21B 17/026 |
| 2024/0418056 | A1* | 12/2024 | Andreychuk | E21B 23/0411 |

* cited by examiner

DOWNHOLE ANCHORING ASSEMBLY

FIELD

The present disclosure relates to a downhole anchoring assembly for anchoring of a flow conductor, such as, for example, a production string, to a wellbore string, such as, for example, casing string.

BACKGROUND

To produce reservoir fluids from a reservoir disposed within a subterranean formation, a flow conductor (such as, for example, a production string) is installed within a wellbore that is lined with a casing string. It is desirable to anchor the flow conductor to the casing string. When anchoring the production string to the casing string, it is desirable to mitigate flow disturbance presented by the anchor.

SUMMARY

In one aspect, there is provided an anchoring assembly configured for integration within a flow conductor that is emplaceable within a wellbore string, that is disposed within a wellbore that extends into a subterranean formation, wherein the anchoring assembly is transitionable from an anchoring ineffective state to an anchoring effective state for effecting anchoring of the flow conductor to the wellbore string, comprising:

an anchoring tool including:

an anchoring tool mount, including an outermost surface;

an anchor configuration coupled to the anchoring tool mount; and an anchoring tool channel configuration that is recessed within the outermost surface of the anchoring tool mount;

wherein:

the anchoring tool channel configuration is disposed, relative to the anchor configuration, in an alignment which is effective for conducting reservoir fluid past the anchor configuration.

In another aspect, there is provided an anchoring assembly configured for integration within a flow conductor that is emplaceable within a wellbore string, that is disposed within a wellbore that extends into a subterranean formation, wherein the anchoring assembly is transitionable from an anchoring ineffective state to an anchoring effective state for effecting anchoring of the flow conductor to the wellbore string, comprising:

an anchoring tool including:

an anchoring tool mount; and an anchor configuration coupled to the anchoring tool mount;

wherein:

the transitioning includes displacement of the anchor configuration, outwardly relative to the central longitudinal axis of the anchoring tool mount, with effect that:

the anchoring configuration becomes disposed further outwardly, relative to the central longitudinal axis of the anchoring assembly, than in the anchoring-ineffective state; and the anchor configuration becomes engaged to the wellbore string such that:

the anchor configuration is engaged to the wellbore string over an interfacial area that is defined by a total axial length of at least two (2) inches; and the anchoring of the flow conductor to the wellbore string is established.

In another aspect, there is provided an anchoring assembly configured for integration within a flow conductor that is emplaceable within a wellbore string, that is disposed within a wellbore that extends into a subterranean formation, wherein the anchoring assembly is transitionable from an anchoring ineffective state to an anchoring effective state for effecting anchoring of the flow conductor to the wellbore string, comprising:

an anchoring tool including:

an anchoring tool mount, including an outermost surface;

an anchor configuration coupled to the anchoring tool mount; and a spacer extending outwardly from the outermost surface of the anchoring tool mount;

wherein:

the anchoring assembly is co-operable with the wellbore string such that, while the flow conductor is established and disposed within the wellbore string:

the transitioning includes displacement of the anchor configuration, outwardly relative to the central longitudinal axis of the anchoring tool mount, with effect that:

the anchoring configuration becomes disposed further outwardly, relative to the central longitudinal axis of the anchoring tool mount, than in the anchoring-ineffective state; and the anchor configuration becomes engaged to the wellbore string such that the anchoring of the flow conductor to the wellbore string is established; and the anchoring assembly becomes emplaced eccentrically relative to the central longitudinal axis of the wellbore string;

and the anchor configuration and the spacer are co-operable with the wellbore string such that, while the anchoring assembly is integrated within the flow conductor, that is disposed within the wellbore string, and the anchoring assembly is disposed in the anchoring-effective state, displacement, of the anchoring tool mount, relative to the central longitudinal axis of the wellbore string, being urged by application of a tensile force to the flow conductor in the uphole direction, and which is sufficient to defeat the anchoring, is resisted.

In another aspect, there is provided an anchoring assembly configured for integration within a flow conductor that is emplaceable within a wellbore string, that is disposed within a wellbore that extends into a subterranean formation, wherein the anchoring assembly is transitionable from an anchoring ineffective state to an anchoring effective state for effecting anchoring of the flow conductor to the wellbore string, comprising:

an anchoring tool including:

an anchoring tool mount, including an outermost surface;

an anchor configuration coupled/mounted to the anchoring tool mount;

and a spacer;

wherein:

the anchoring assembly is co-operable with the wellbore string such that, while the anchoring assembly in integrated with the flow conductor, that is disposed within the wellbore string, the transitioning includes displacement, of the anchor configuration, outwardly relative to the central longitudinal axis of the anchoring tool mount, in response to application of a tensile force to the flow conductor in the uphole direction;

the anchor configuration and the spacer are co-operable with the wellbore string such that, while the flow conductor is established and disposed within the wellbore string, and while the transitioning is being effected, emplacement of the anchor configuration, at an angled orientation relative to the wellbore string, is resisted, such that the transitioning is with effect that:

the anchoring configuration becomes disposed further outwardly, relative to the central longitudinal axis of the anchoring assembly, than in the anchoring-ineffective state; and the anchor configuration becomes engaged to the wellbore string such that the anchoring configuration is disposed in flush engagement with the wellbore string and the anchoring of the flow conductor to the wellbore string is established.

In another aspect, there is provided an anchoring assembly configured for integration within a flow conductor that is emplaceable within a wellbore string, that is disposed within a wellbore that extends into a subterranean formation, wherein the anchoring assembly is transitionable from an anchoring ineffective state to an anchoring effective state for effecting anchoring of the flow conductor to the wellbore string, comprising: an anchoring tool, wherein, within a plane which traverses the anchor configuration, the cross-sectional area, occupied by the anchoring tool, is less than 12.5 square inches.

In another aspect, there is provided an anchoring assembly configured for integration within a flow conductor that is emplaceable within a wellbore string, that is disposed within a wellbore that extends into a subterranean formation, wherein the anchoring assembly is transitionable from an anchoring ineffective state to an anchoring effective state for effecting anchoring of the flow conductor to the wellbore string, comprising:

an anchoring tool including:

an anchor configuration; and a drag block configuration;

wherein:

the anchor configuration and the drag block configuration are co-operatively configured such that there is an absence of resistance to the actuation of the anchor configuration by a biasing force configuration which is biasing the drag block configuration into the contact engagement with the wellbore string.

BRIEF DESCRIPTION OF DRAWINGS

Reference will now be made, by way of example, to the accompanying drawings which show example embodiments, and in which.

DETAILED DESCRIPTION

Figure 1:
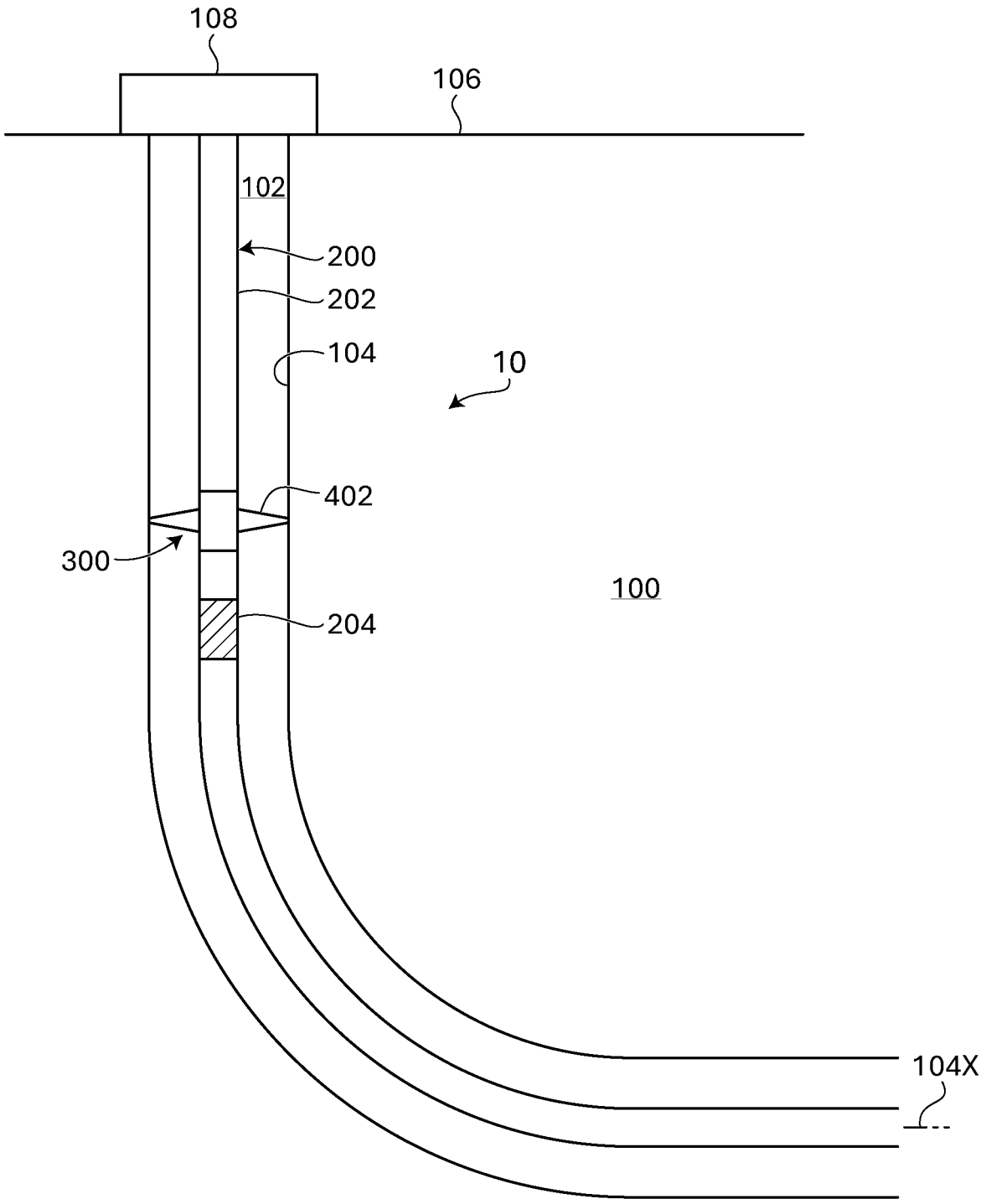
FIG. 1 is a schematic illustration of an embodiment of a system, of the present disclosure.

Disclosed herein is an anchoring assembly 300 that is configured for integration within a flow conductor 200. The flow conductor 200 is emplaceable within a wellbore string 104. The wellbore string 104 is disposed within a wellbore 102 that extends into a subterranean formation 100. The anchoring assembly 300 and the flow conductor 200 are co-operably configured such that, while the anchoring assembly 300 is integrated within the flow conductor 200, and the flow conductor 200 is disposed within the wellbore string 104, the flow conductor 200 is anchorable to the wellbore string 104. In some embodiments, for example the integration of the anchoring assembly 300 within the flow conductor 200 is via threaded coupling.

The flow conductor 200 defines a flow passage 201 for conducting reservoir fluid. In some embodiments, for example, the flow conductor 200 is defined by a production string 202. In some embodiments, for example, the flow conductor 200 includes coiled tubing.

In some embodiments, for example, the anchoring assembly 300 further defines an anchoring assembly flow passage. The anchoring assembly flow passage defines a portion of the flow conductor passage 201.

In some embodiments, for example, the wellbore string 104 is defined by a casing string 104 that is lining the wellbore 102.

The anchoring assembly 300 includes an anchoring tool 400 and an actuator tool 500. The anchoring tool 400 and the actuator tool 500 are co-operatively configured such that, while the anchoring assembly 300 is integrated within the flow conductor 200, the anchoring tool 400 is actuatable by the actuator tool 500, for effecting anchoring of the flow conductor 200 (and, in some embodiments, for example, the production string 202) to the wellbore string 104, in response to relative displacement between the anchoring tool 400 and the actuator tool 500. In this respect, the anchoring tool 400 and the actuator tool 500 are displaceable relative to one another. In this respect, the anchoring assembly 300 is configurable in an anchoring-effective state. Also in this respect, the anchoring assembly 300 is co-operable with the wellbore string 104, such that, while the anchoring assembly 300 is coupled to a flow conductor 200 that is disposed within the wellbore string 104, and is disposed in the anchoring-effective state, the downhole assembly 300 is anchored to the wellbore string 104 by the anchor configuration 402. The anchoring assembly 300 is transitionable from an anchoring-ineffective state to the anchoring effective state for effecting anchoring of the flow conductor 200 (and, in some embodiments, for example, the production string 202) to the wellbore string 104. In this respect, the anchoring assembly 300 is co-operable with the wellbore string 104, such that, while the anchoring assembly 300 is coupled to a flow conductor 200 that is disposed within the wellbore string 104, and is disposed in the anchoring-ineffective state, there is an absence of anchoring of the flow conductor 200 (and, in some embodiments, for example, the production string 202) to the wellbore string 104.

Referring to FIG. 1, there is provided a system 10, for producing hydrocarbon material, via the wellbore 102, from a reservoir, disposed within a subterranean formation 100, to the surface 106.

As used herein, the terms "up", "upward", "upper", or "uphole", mean, relativistically, in closer proximity to the surface 106 and further away from the bottom of the wellbore 102, when measured along the longitudinal axis of the wellbore 102. The terms "down", "downward", "lower", or "downhole" mean, relativistically, further away from the surface 106 and in closer proximity to the bottom of the wellbore 102, when measured along the longitudinal axis of the wellbore 102.

The wellbore 102 can be straight, curved, or branched. The wellbore 102 can have various wellbore portions. A wellbore portion is an axial length of a wellbore 102. A wellbore portion can be characterized as "vertical" or "horizontal" even though the actual axial orientation can vary from true vertical or true horizontal, and even though the axial path can tend to "corkscrew" or otherwise vary. The term "horizontal", when used to describe a wellbore portion, refers to a horizontal or highly deviated wellbore portion as understood in the art, such as, for example, a wellbore portion having a longitudinal axis that is between about 70 and about 110 degrees from vertical. The term "vertical", when used to describe a wellbore portion, refers to a vertical or highly deviated vertical portion as understood in the art, such as, for example, a wellbore portion having a longitudinal axis that is less than about 20 degrees from the vertical.

"Reservoir fluid" is fluid that is contained within the reservoir. Reservoir fluid may be liquid material, gaseous material, or a mixture of liquid material and gaseous material. In some embodiments, for example, the reservoir fluid includes water and hydrocarbons, such as oil, natural gas condensates, or any combination thereof.

Fluids may be injected into the oil reservoir through the wellbore to effect stimulation of the reservoir fluid. For example, such fluid injection is effected during hydraulic fracturing, water flooding, water disposal, gas floods, gas disposal (including carbon dioxide sequestration), steam-assisted gravity drainage ("SAGD") or cyclic steam stimulation ("CSS"). In some embodiments, for example, the same wellbore is utilized for both stimulation and production operations, such as for hydraulically fractured formations or for formations subjected to CSS. In some embodiments, for example, different wellbores are used, such as for formations subjected to SAGD, or formations subjected to waterflooding.

The wellbore string 104 is employed within the wellbore 102 for stabilizing the subterranean formation 100. In some embodiments, for example, the wellbore string 104 also contributes to effecting fluidic isolation of one zone within the subterranean formation 100 from another zone within the subterranean formation 100.

The fluid productive portion of the wellbore 102 may be completed either as a cased-hole completion or an open-hole completion.

A cased-hole completion involves running the wellbore string 104 down into the wellbore through the production zone.

In some embodiments, for example, the annular region between the deployed wellbore wellbore string 104 and the subterranean formation 100 is filled with cement for effecting zonal isolation (see below). The cement is disposed between the wellbore casing and the oil reservoir for the purpose of effecting isolation, or substantial isolation, of one or more zones of the oil reservoir from fluids disposed in another zone of the oil reservoir. Such fluids include reservoir fluid being produced from another zone of the oil reservoir (in some embodiments, for example, such reservoir fluid being flowed through a production tubing string disposed within and extending through the wellbore casing to the surface), or injected fluids such as water, gas (including carbon dioxide), or stimulations fluids such as fracturing fluid or acid. In this respect, in some embodiments, for example, the cement is provided for effecting sealing, or substantial sealing, of flow communication between one or more zones of the oil reservoir and one or more others zones of the oil reservoir (for example, such as a zone that is being produced). By effecting the sealing, or substantial sealing, of such flow communication, isolation, or substantial isolation, of one or more zones of the oil reservoir, from another subterranean zone (such as a producing formation), is achieved. Such isolation or substantial isolation is desirable, for example, for mitigating contamination of a water table within the oil reservoir by the reservoir fluid (e.g. oil, gas, salt water, or combinations thereof) being produced, or the above-described injected fluids.

In some embodiments, for example, the cement is disposed as a sheath within an annular region between the wellbore casing and the oil reservoir. In some embodiments, for example, the cement is bonded to both of the wellbore string 104 and the subterranean formation 100.

In some embodiments, for example, the cement also provides one or more of the following functions: (a) strengthens and reinforces the structural integrity of the wellbore, (b) prevents, or substantially prevents, produced reservoir fluid of one zone from being diluted by water from other zones. (c) mitigates corrosion of the wellbore casing, (d) at least contributes to the support of the wellbore casing, and e) allows for segmentation for stimulation and fluid inflow control purposes.

The cement is introduced to an annular region between the wellbore string 104 and the subterranean formation 100 after the subject wellbore wellbore string 104 has been run into the wellbore. This operation is known as "cementing".

In some embodiments, for example, the wellbore string 104 includes one or more casing strings, each of which is positioned within the well bore, having one end extending from the well head. In some embodiments, for example, each casing string is defined by jointed segments of pipe. The jointed segments of pipe typically have threaded connections.

Typically, a wellbore contains multiple intervals of concentric casing strings, successively deployed within the previously run casing. With the exception of a liner string, casing strings typically run back up to the surface 106. Typically, casing string sizes are intentionally minimized to minimize costs during well construction. Generally, smaller casing sizes make production and artificial lofting more challenging.

For wells that are used for producing reservoir fluid, few of these actually produce through wellbore casing. This is because producing fluids can corrode steel or form undesirable deposits (for example, scales, asphaltenes or paraffin waxes) and the larger diameter can make flow unstable. In this respect, a production string 202 is usually installed inside the last casing string. The production string 202 is provided to conduct reservoir fluid, received within the wellbore, to a wellhead 108, from which the production string 202 is hung. In some embodiments, for example, the annular region between the last casing string and the production string 202 may be sealed at the bottom by a packer.

To facilitate flow communication between the reservoir and the wellbore 102, the wellbore wellbore string 104 may be perforated, or otherwise include per-existing ports (which may be selectively openable, such as, for example, by shifting a sleeve), to provide a fluid passage for enabling flow of reservoir fluid from the reservoir to the wellbore 102.

In some embodiments, for example, the entirety of the wellbore wellbore string 104 does not extend back to the wellhead 108, and the lowermost section of the wellbore wellbore string 104 is set short of total depth. Hanging off from the bottom of that portion of the wellbore wellbore string 104 that extends back to the wellhead 108, with a liner hanger or packer, is a liner string. The liner string can be made from the same material as the casing string, but, unlike the casing string, the liner string does not extend back to the wellhead 116. Cement may be provided within the annular region between the liner string and the oil reservoir for effecting zonal isolation (see below), but is not in all cases. In some embodiments, for example, this liner is perforated to effect flow communication between the reservoir and the wellbore. In this respect, in some embodiments, for example, the liner string can also be a screen or is slotted. In some embodiments, for example, the production tubing string may be engaged or stung into the liner string, thereby providing a fluid passage for conducting the produced reservoir fluid to the wellhead 108. In some embodiments, for example, no cemented liner is installed, and this is called an open hole completion or uncemented casing completion.

An open-hole completion is effected by drilling down to the top of the producing formation, and then lining the wellbore with the wellbore string 104. The wellbore is then drilled through the producing formation, and the bottom of the wellbore is left open (i.e. uncased), to effect flow communication between the reservoir and the wellbore. Open-hole completion techniques include bare foot completions, pre-drilled and pre-slotted liners, and open-hole sand control techniques such as stand-alone screens, open hole gravel packs and open hole expandable screens. Packers and casing can segment the open hole into separate intervals and ported subs can be used to effect flow communication between the reservoir and the wellbore.

Referring to FIG. 1, a system 10 is provided for effecting production of reservoir fluid from the reservoir of the subterranean formation 100. The system 10 includes the flow conductor 200 (which, in some embodiments, for example, is defined by a production string 202) that is disposed within the wellbore 102.

The production string 202 further includes a pump 204. The pump 204 is provided to, through mechanical action, pressurize and effect conduction of the reservoir fluid from the subterranean formation 100, through the wellbore 102, and to the surface 106, and thereby effect production of the reservoir fluid. It is understood that the reservoir fluid being conducted uphole through the wellbore 102, via the production string 202, may be additionally energized by supplemental means, including by gas-lift. In some embodiments, for example, the pump 204 is a sucker rod pump. Other suitable pumps 204 include progressive cavity screw pumps, electrical submersible pumps, and jet pumps.

The pump 204 is configured for inducing flow of reservoir fluid, via a downhole portion of the flow conductor 200, from the subterranean formation 100 to the pump suction, pressurizing the reservoir fluid flow, and discharging the pressurized reservoir fluid flow for flow through an uphole portion of the flow conductor 200 to the surface 106.

As discussed above, the wellbore 102 is disposed in fluid communication (such as through perforations provided within the installed casing or liner, or by virtue of the open hole configuration of the completion), or is selectively disposable into fluid communication (such as by perforating the installed casing, or by actuating a valve to effect opening of a port), with the reservoir of the subterranean formation 100. When disposed in fluid communication with the reservoir of the subterranean formation 100, the wellbore 102 is disposed for receiving reservoir fluid flow from the reservoir 104.

During operation of the pump 204 to produce reservoir fluid at the surface 106, it is desirable to anchor the flow conductor 200 to the wellbore string 104 for maintaining tension in the flow conductor 200 and reducing movement of the flow conductor 200. By maintaining tension in the flow conductor 200 and reducing movement of the flow conductor 200 during operation of the pump 204, pump efficiency may be increased, and maintenance and down time caused by wear and tear of the flow conductor 200 and the pump 204, may be decreased. The anchoring assembly 300, is provided to, amongst other things, perform these functions. In this respect, in some embodiments, for example, the anchoring assembly 300 is emplaceable uphole relative to the pump 200 and is connected to the flow conductor 200. In some embodiments, for example, the anchoring assembly 300 is emplaceable downhole relative to the pump 200 when connected to the flow conductor 200.

Figure 8:
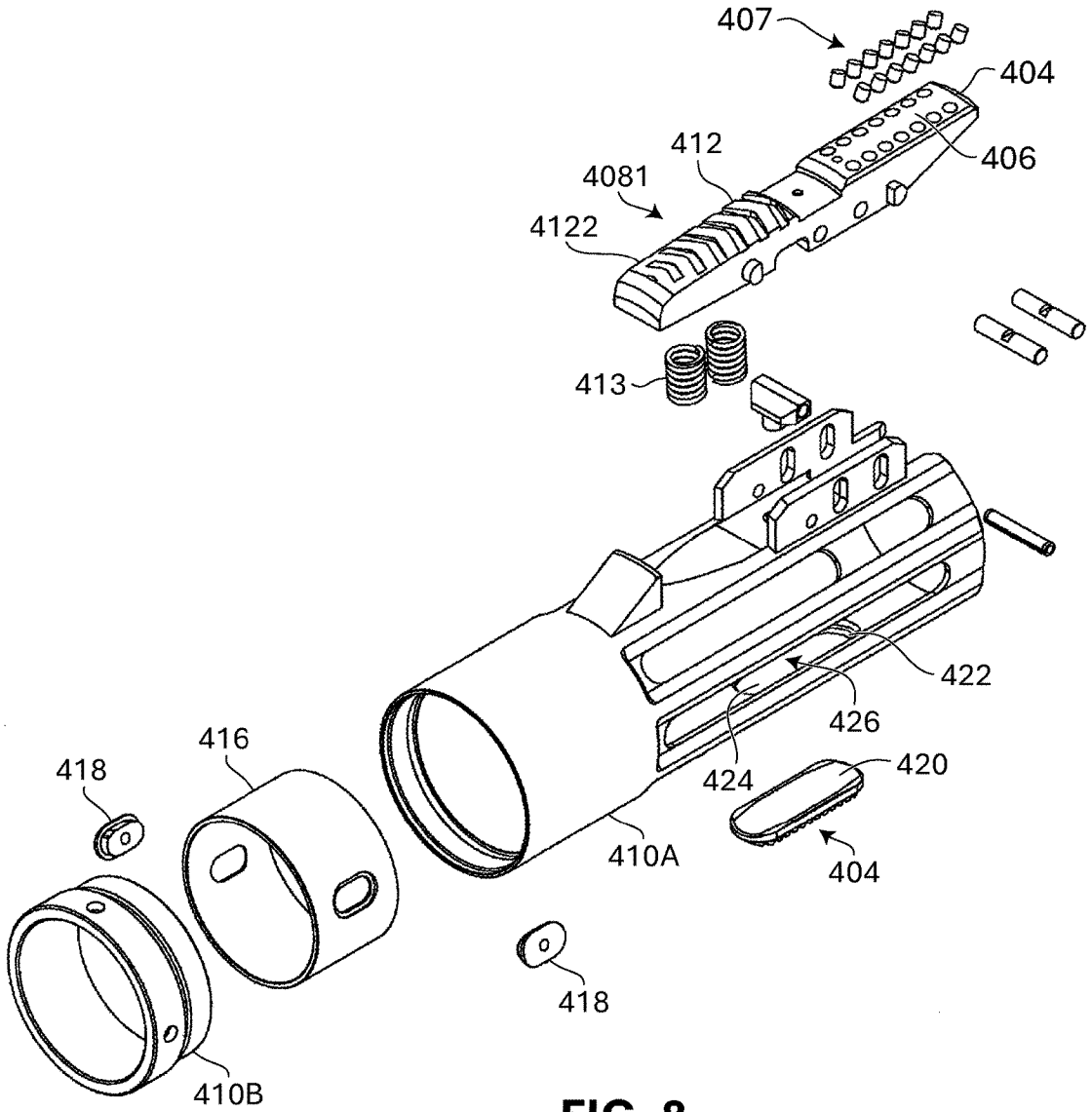
FIG. 8 is an exploded view of an embodiment of an anchoring tool.
Figure 9:
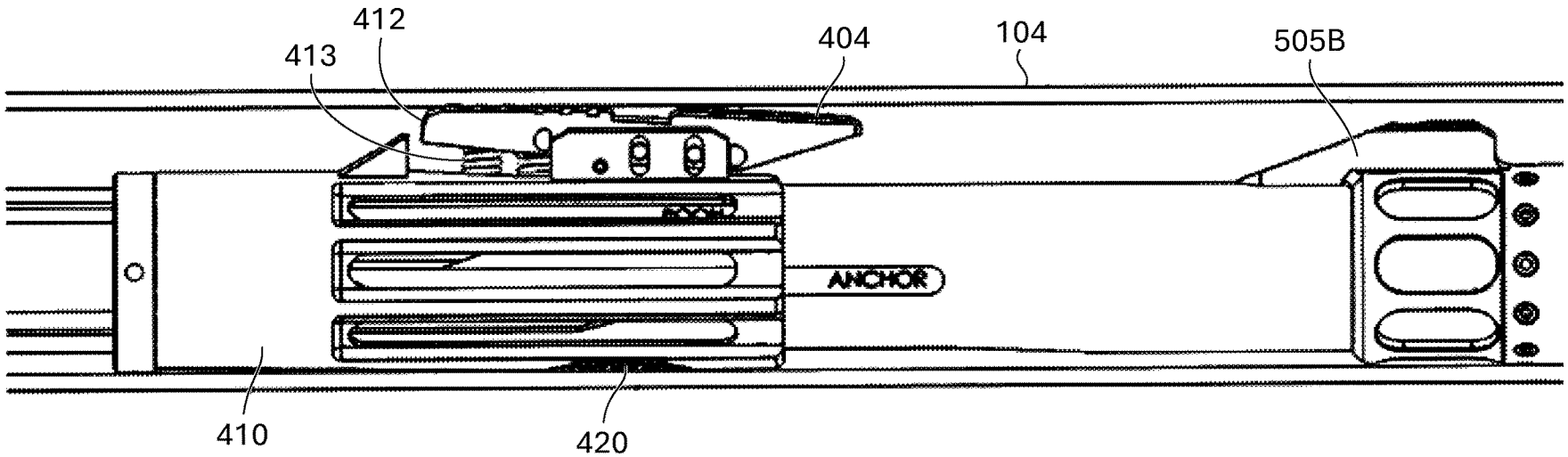
FIG. 9 is a cut-away side view of a casing within which the anchoring assembly, illustrated in FIG. 2, is disposed in an anchoring-ineffective state.
Figure 11:
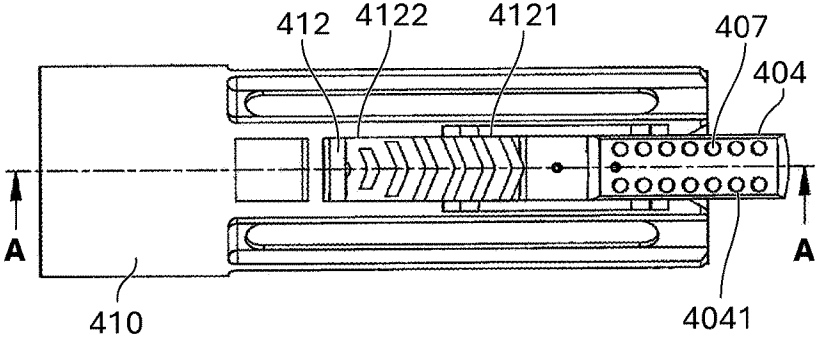
FIG. 11 is a top plan view of the anchoring tool illustrated in FIG. 10.
Figure 10:
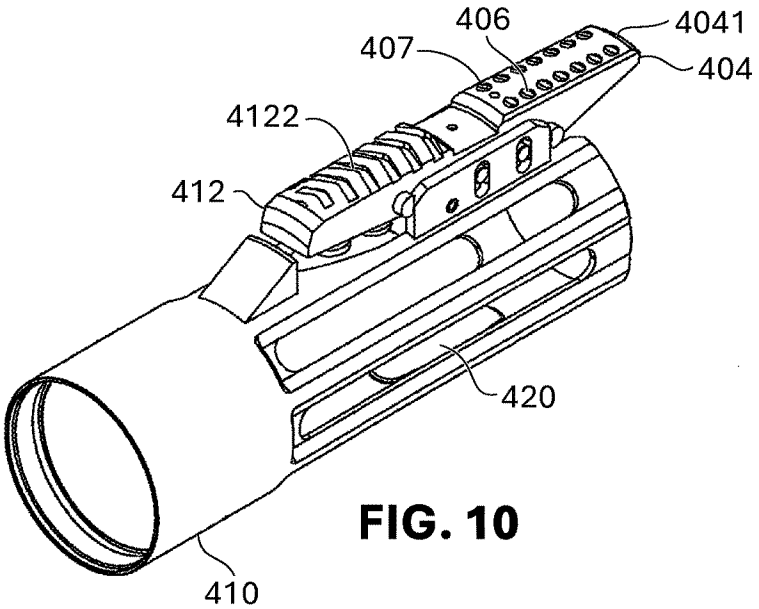
FIG. 10 is a perspective view of an embodiment of an anchoring tool, disposed in an anchoring-ineffective state.
Figure 13:
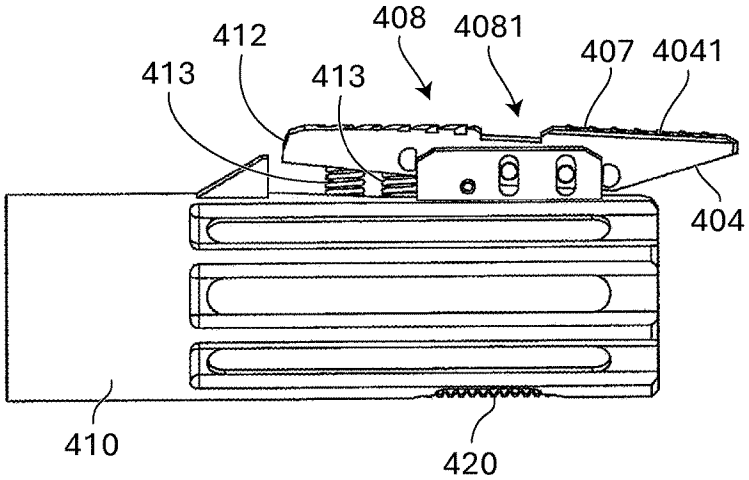
FIG. 13 is a side view of the anchoring tool illustrated in FIG. 11.
Figure 12:
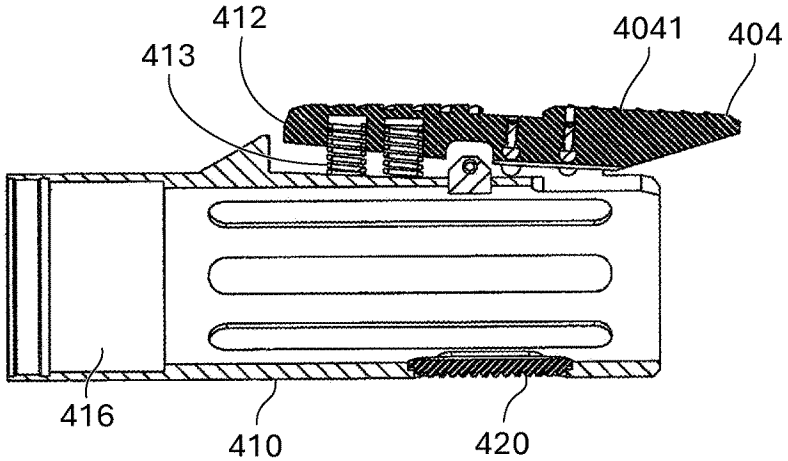
FIG. 12 is a sectional view of the anchoring tool illustrated in FIG. 10, taken along lines A-A in FIG. 11.

Referring to FIG. 8, in some embodiments, for example, the anchoring tool 400 includes an anchoring tool mount 410 and a wellbore string engagement configuration 401. The wellbore string engagement configuration 401 is mounted to the anchoring tool mount 410.

The wellbore string engagement configuration 401 includes an anchor configuration 402. In some embodiments, for example, the transitioning, from an anchoring-ineffective state to the anchoring effective state, includes outwardly displacement, of the anchor configuration 402, relative to the central longitudinal axis 410X of the anchoring tool mount 410 (and, in some embodiments, the central longitudinal axis 201X of the flow passage 201 of the flow conductor 200), with effect that: the anchor configuration 402 becomes disposed further outwardly, relative to the central longitudinal axis 410X of the anchoring tool mount 410 (and, in some embodiments, the central longitudinal axis 201X of the flow passage 201 of the flow conductor 200), than in the anchoring-ineffective state, and the anchor configuration 402 becomes engaged to the wellbore string 104 such that the anchoring of the flow conductor 200 (and, in some embodiments, for example, the production string 202) to the wellbore string 104 is established. In some embodiments, for example, the engagement, of the anchor configuration 402 to the wellbore string 104, is with additional effect that the anchor configuration 402 is disposed in flush engagement with the wellbore string 104. In some embodiments, for example, the transitioning is motivated by an application of tensile force to the anchoring assembly 300 in the uphole direction.

The anchor configuration 402 is defined by a plurality of anchors 404 that are angularly spaced relative to one another. Each one of the anchors 404, independently, defines a wellbore string-engaging surface 406 configured for gripping engagement (such as, for example, a "biting" engagement") of the wellbore string 104. In some embodiments, for example, the wellbore string-engaging surface 406 is defined by a slip, such as, for example, a mechanical slip. In some embodiments, for example, the mechanical slip is a button-type slip, such that the wellbore string-engaging surface 406 is defined by button inserts 407.

In some embodiments, for example, while the anchoring assembly 300 is coupled to a flow conductor 200 that is disposed within the wellbore string 104, and is disposed in the anchoring-ineffective state (see FIGS. 9 to 13), each one of the anchors 404, independently, is spaced apart from the wellbore string 104, such that, for each one of the anchors 404, independently, there is an absence of engagement of the wellbore string 104 by the anchor 404.

In some embodiments, for example, while the anchoring assembly 300 is coupled to a flow conductor 200, that is disposed within the the wellbore string 104, and is disposed in the anchoring-effective state (see FIGS. 14 to 18), each one of the anchors 404, independently, is engaged to the wellbore string 104.

In some embodiments, for example, while the anchoring assembly 300 is coupled to a flow conductor 200 that is disposed within the wellbore string 104, transitioning from the anchoring-ineffective state to the anchoring-effective state is effectuated by the actuator tool 500, and the transitioning includes, for each one of the anchors 404, independently, a laterally outwardly displacement of the anchor 404, relative to the central longitudinal axis 410X of the anchoring tool mount 410 (and, in some embodiments, the central longitudinal axis 201X of the flow passage 201 of the flow conductor 200). In some embodiments, for example, for each one of the anchors 404, independently, the laterally outwardly displacement is with effect that the anchor 404 is displaced from a retracted position to an extended position.

Figure 2:
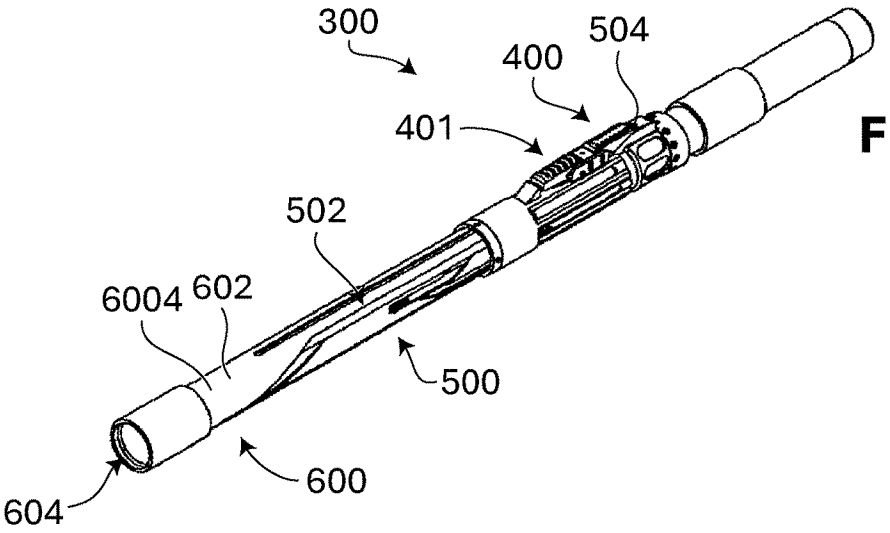
FIG. 2 is a perspective view of an embodiment of an anchoring assembly.
Figure 3:
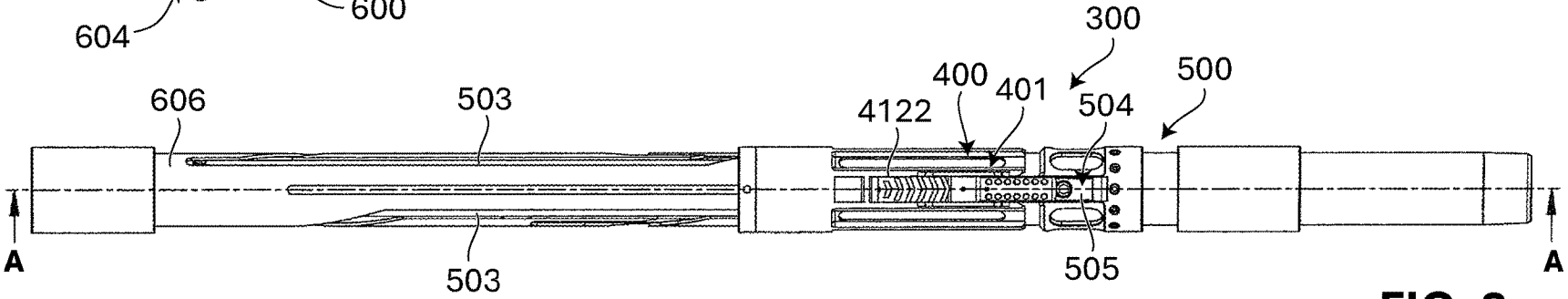
FIG. 3 is a top plan view of the anchoring assembly illustrated in FIG. 2.
Figure 4:
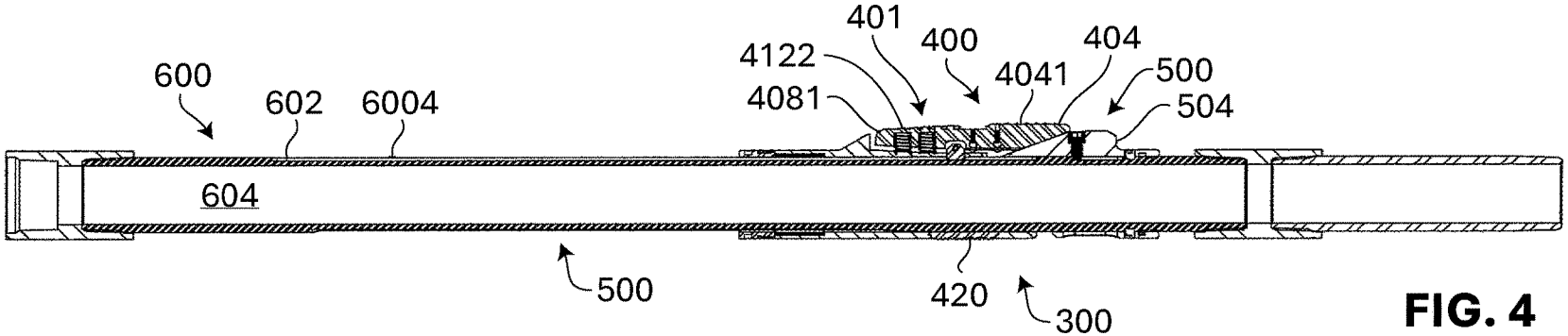
FIG. 4 is a sectional view of the anchoring assembly illustrated in FIG. 3, taken along lines A-A.
Figure 5:
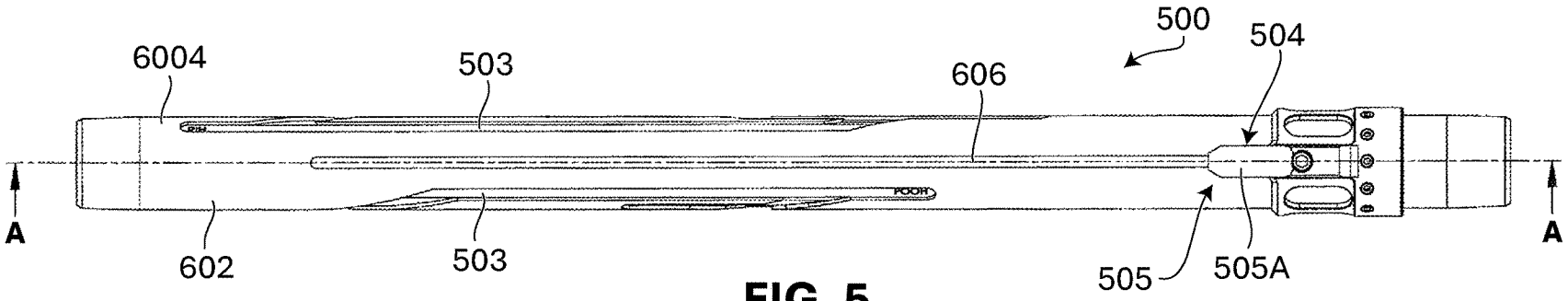
FIG. 5 is a top plan view of an embodiment of an actuator tool.
Figure 6:
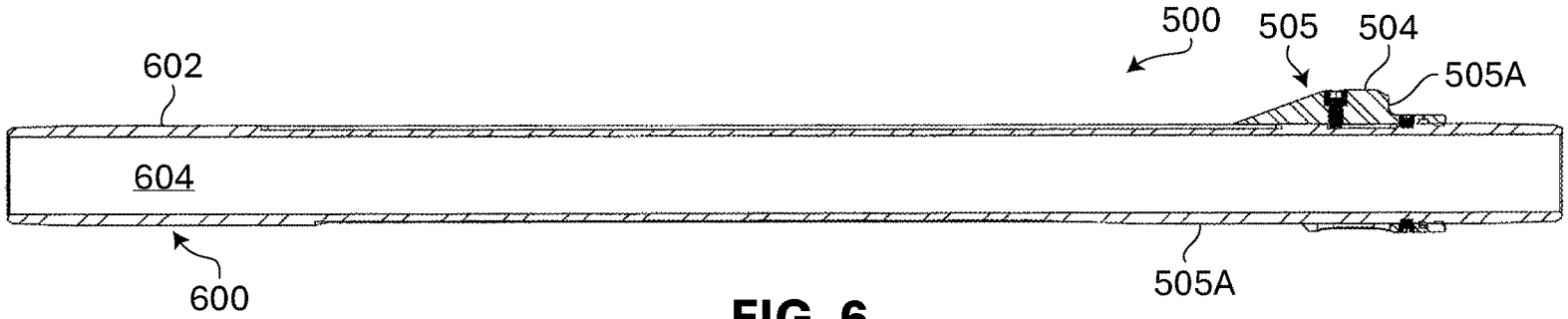
FIG. 6 is sectional view of the actuator tool illustrated in FIG. 5, taken along lines A-A.
Figure 7:
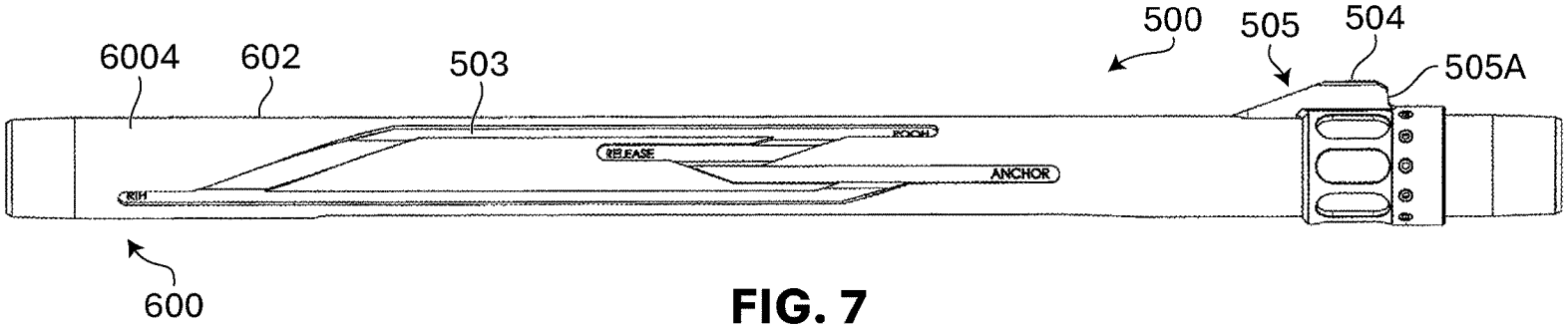
FIG. 7 is a side view of the actuator tool illustrated in FIG. 5.

Referring to FIGS. 2 to 4, and as described above, the actuator tool 500 is configured for actuating the anchoring tool 400 for anchoring the flow conductor 200 to the wellbore string 104. In some embodiments, for example, the actuator tool 500 includes an actuator tool mount 602, and the actuator tool mount 602 also defines a passage 604 which defines the anchoring assembly flow passage and, therefore, functions as a portion of a flow passage 201 of the flow conductor 200. In this respect, the actuator tool mount 602 defines a portion of the flow conductor 200 (e.g. the production string 202), such that the integration of the anchoring assembly 300 within the flow conductor 200 is defined by an integration of the actuator tool mount 602 within the flow conductor 200.

Figure 21A:
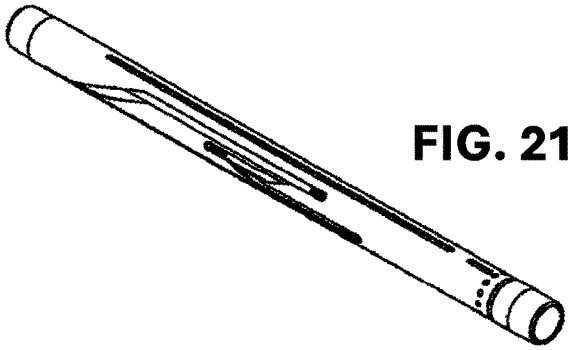
FIG. 21A is a perspective view of a mandrel of the actuator tool illustrated in FIG. 5.
Figure 21B:
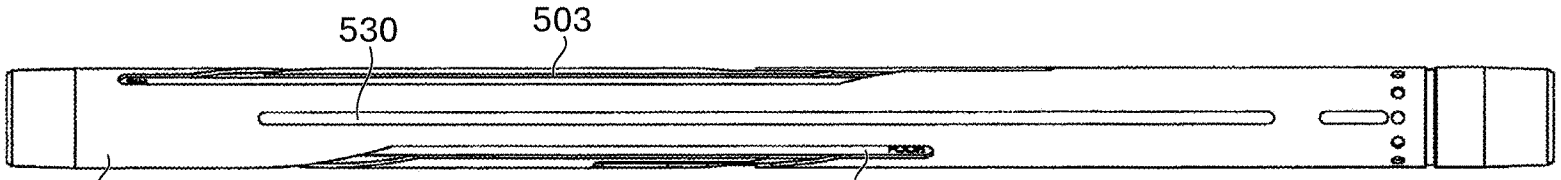
FIG. 21B is a top plan view of the mandrel illustrated in FIG. 21A.
Figure 21C:
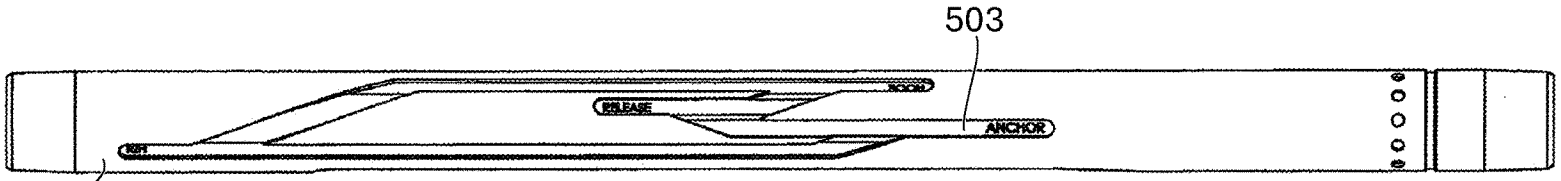
FIG. 21C is a side view of the mandrel illustrated in FIG. 21B.

In some embodiments, for example, the actuator tool 500 further includes a guide 530 (see FIG. 21B) that is defined within an outermost surface 604 of the actuator tool mount 602 The guide 530 is configured for guiding displacement of the the actuator tool 500 relative to the anchoring tool 400, including guiding travel of the inclined surface configuration 504 towards the anchor configuration 402 for effecting alignment between the anchor configuration 402 and the inclined surface configuration 504 for motivating the transitioning from the anchoring-ineffective state to the anchoring-effective state. In some embodiments, for example, the guide 530 is defined by a j-slot configuration 502. In some embodiments, for example, the j-slot configuration 502 is defined by the outermost surface 6004 of the actuator tool mount 602 of the actuator tool 500. The j-slot configuration 502 is defined by at least one j-slot 503. In some embodiments, for example, and as described herein, the j-slot configuration 502 is defined by at least two j-slots 503 (see FIGS. 5 to 7, and FIGS. 19A-D). The j-slot configuration 502 is co-operable with the anchoring tool 400 for effecting setting (e.g. transitioning the anchoring assembly 300 from the anchoring-ineffective state to the anchoring-effective state) and unsetting (e.g. transitioning the anchoring assembly 300 from the anchoring-effective state to the anchoring-ineffective state) of the anchoring tool 400 in response to uphole and downhole movements of the flow conductor 200, as is described below. The j-slot configuration 502 enables relative movement between the flow conductor 200 (and, therefore, the actuator tool 500) and the anchoring tool 400, as will be further described below.

In some embodiments, for example, the actuator tool 500 further includes an inclined surface configuration 504 for urging the actuation of the anchoring tool 400. In this respect, for each one of the anchors 404, independently, the laterally outwardly displacement of the anchor 404, relative to the central longitudinal axis 410X of the anchoring tool mount 410, is actuated by a respective inclined surface 505 of the inclined surface configuration 504. In some embodiments, for example, for each one of the anchors 404, independently, the anchor 404 and the respective inclined surface 505, are co-operative configured such that, the transitioning of the anchoring assembly 300 from the actuator-ineffective state to the actuator-effective state is effectuated in response to the laterally outwardly displacement of the anchor 404, relative to the central longitudinal axis 410X of the anchoring tool mount 410, urged by the respective inclined surface 505 while a tensile force is being applied to the actuator tool 500 (and, therefore, the respective inclined surface 505) in an uphole direction (such as, for example, while the actuator tool 500 is being pulled uphole).

In those embodiments where the actuator tool 500 includes a j-slot configuration 502, actuation of the anchoring tool 400 by the inclined surface configuration 504 is dependent on positioning of the anchoring tool 400 relative to the actuator tool 500, such relative positioning being based on, for each one of the at least one j-slot 503, position of the anchoring tool 400 within the j-slot 503, and such relative positioning being capable of modification in response to movement of the anchoring tool 400 through the at least one j-slot 503.

In some embodiments, for example, at least one of the anchors 404 is a wedge-actuatable anchor 4041, such that a wedge-actuatable anchor configuration 402A is defined by at least one wedge-actuatable anchor 4041, and such that the anchor configuration 402 includes a wedge-actuatable anchor configuration 402A. For each one of the at least one wedge-actuatable anchor 4041 independently, the inclined surface 505 is defined by a respective wedge 505A, for effecting actuation of the laterally-extending wedge-actuatable anchor 4041, such that the inclined surface configuration includes a wedge configuration defined by at least one wedge 505A (e.g. a cone). In some embodiments, for example, the wedge configuration is mounted on the actuator tool mount 602.

For each one of the at least one wedge-actuatable anchor 4041, independently, the wedge-actuatable anchor 4041, the outermost surface 4006 of the anchoring tool mount 410, and the respective wedge 505A are co-operatively configured such that wedging, of the respective wedge 505A between the anchor 4041 and the outermost surface 4006 of the anchoring tool mount 410, motivates the laterally outwardly displacement of the anchor 4041, relative to the central longitudinal axis 410X, that is effectuated during the transitioning from the anchoring-ineffective state to the anchoring-effective state. The wedging is effected in response to application of a tensile force to the actuator tool 500 in the uphole direction.

In some embodiments, for example, each one of the at least one wedge-actuatable anchor 4041 is defined by a rocker 408 that is rotatably mounted to a anchoring tool mount 410 (see FIGS. 14-18, 19A-F, and 20A-C), such that the anchoring tool 400 includes the anchoring tool mount 410 and at least one rocker 408, and the displacement to the extended position is effectuated by rotation of the rocker 408. In some embodiments, for example, the anchoring assembly 300 is biased towards the anchoring-ineffective state. In this respect, in those embodiments where at least one of the anchors 4041 is defined by a rocker 408, in some of these embodiments, for each one of the at least one rocker-defined anchor 4041, independently, a biasing configuration 413, defined by one or more biasing members 413 (e.g. a compression spring), is co-operably mounted relative to the anchoring tool mount 410 and the rocker 408 such that the anchor 4041 is biased towards the retracted position. In some embodiments, for example, the co-operable mounting is such that the biasing member 413 is retained between the anchoring tool mount 410 and the rocker 408. In this respect, for example, while the anchoring assembly 300 is coupled to a flow conductor 200 that is disposed within the wellbore 102 that is lined with the wellbore string 104, in effecting the transitioning from the anchoring-ineffective state to the anchoring-effective state, the actuator tool 500 overcomes the bias of the biasing member 413 (and, in those embodiments where the rocker 408 also embodies a drag block 412, also effecting retraction of the drag block 412, as is explained below).

In those embodiments where the anchor configuration 402 includes a wedge-actuatable anchor configuration 402A, in some of these embodiments, for example, the anchor configuration further includes a cavity-retained anchor configuration 402B defined by at least one cavity-retained anchor 420 (and, in some embodiments, for example, the cavity-retained anchor configuration 402B includes a single cavity-retained anchor 420 only). In this respect, in some embodiments, for example, at least one of the anchors 404 is a cavity-retained anchor 420. For each one of the at least one cavity-retained anchor 420, the actuator tool 500 defines a recessed track 520 (see FIG. 21D and FIG. 27), recessed into the outermost surface 5006 (e.g. of the mandrel 620), and including a ramp 505B, extending to, and merging with the outermost surface 5006. In this respect, in some embodiments, for example, the inclined surface configuration 504 includes the ramp 505B, such that the inclined surface 505, respective to the cavity-retained anchor 420, is defined by the ramp 505B. For each one of the at least one cavity-retained anchor 420 independently, the anchoring tool 400 defines a respective anchor-retaining cavity 422, a respective actuator tool communicator 424, and a respective casing communicator 426. For each one of the at least one cavity-retained anchor 420, independently, the cavity-retained anchor 420, the respective anchor-retaining cavity 422, the respective actuator tool communicator 424, and the respective casing communicator 426 are co-operatively configured such that the cavity-retained anchor 420 is retained to the anchoring tool mount 410 within the respective anchor-retaining cavity 422, and, while the anchoring assembly 300 is disposed within the wellbore 102 lined with the casing 102, the cavity-retained anchor 420, the respective anchor-retaining cavity 422, the respective actuator tool communicator 424, and the respective casing communicator 426 are co-operable with the inclined surface configuration 504 (of the actuator tool 500), such that, while the ramp 505B is disposed in contact engagement with the cavity-retained anchor 420 through the respective actuator tool communicator 424 and the actuator tool 500 is being pulled in the uphole direction, relative to the anchor 420, the cavity-retained anchor 420 is urged by the ramp 505B into contact engagement with the wellbore string 104 via the respective casing communicator 426. In some embodiments, for example, the cavity-retained anchor 420 is coupled to the anchoring tool mount 410 via containment within the cavity 422 only. In some of these embodiments, for example, the cavity-retained anchor 420 is floating within the cavity 422.

Figure 14:
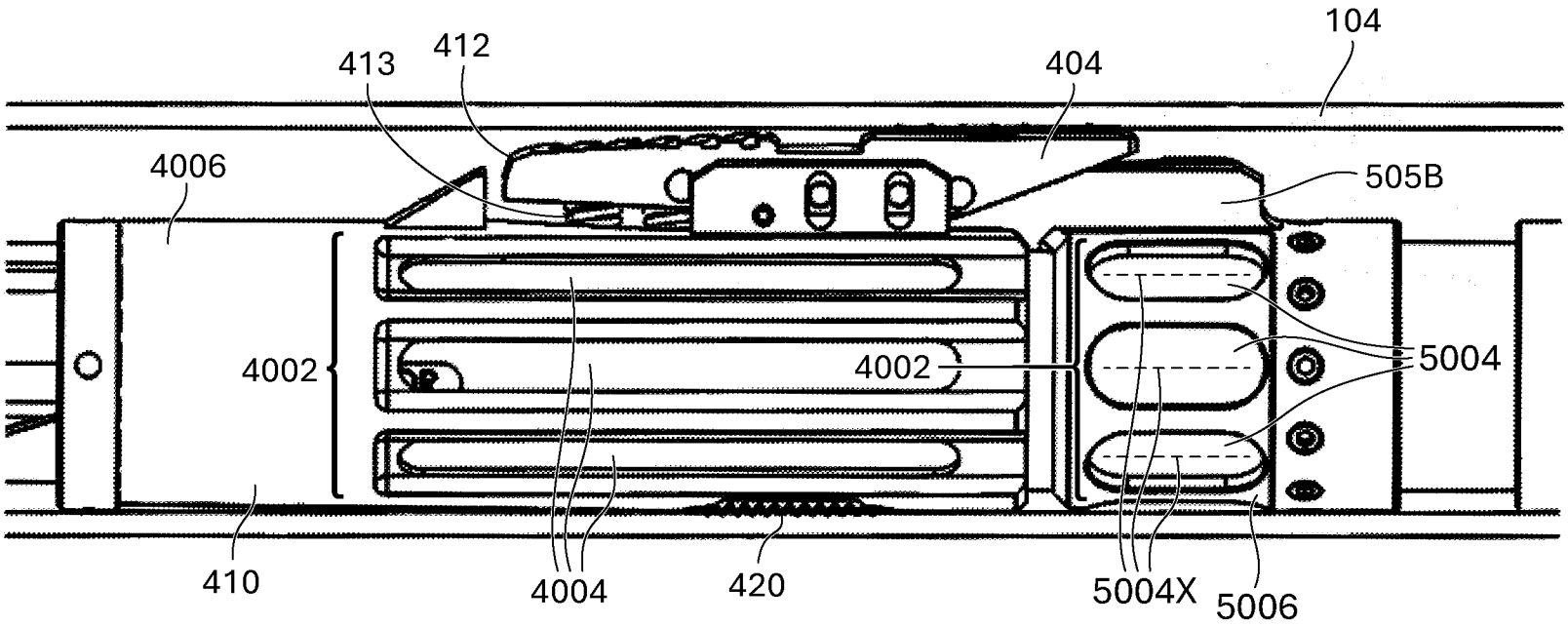
FIG. 14 is a cut-away side view of a casing within which the anchoring assembly, illustrated in FIG. 2, is disposed in an anchoring-effective state.
Figure 16:
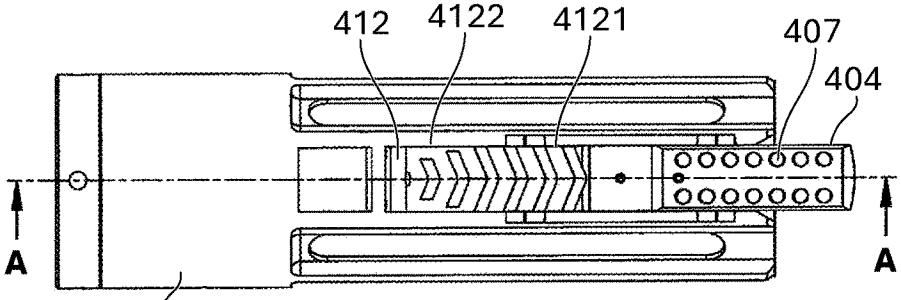
FIG. 16 is a top plan view of the anchoring tool illustrated in FIG. 15.
Figure 18:
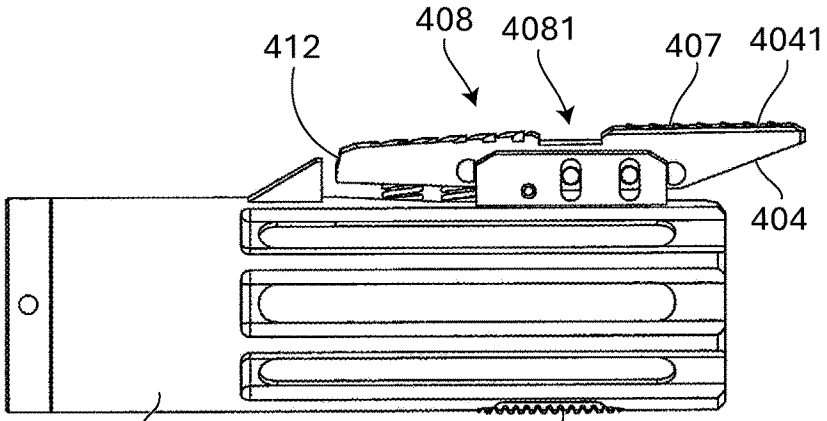
FIG. 18 is a side view of the anchoring tool illustrated in FIG. 15.
Figure 15:
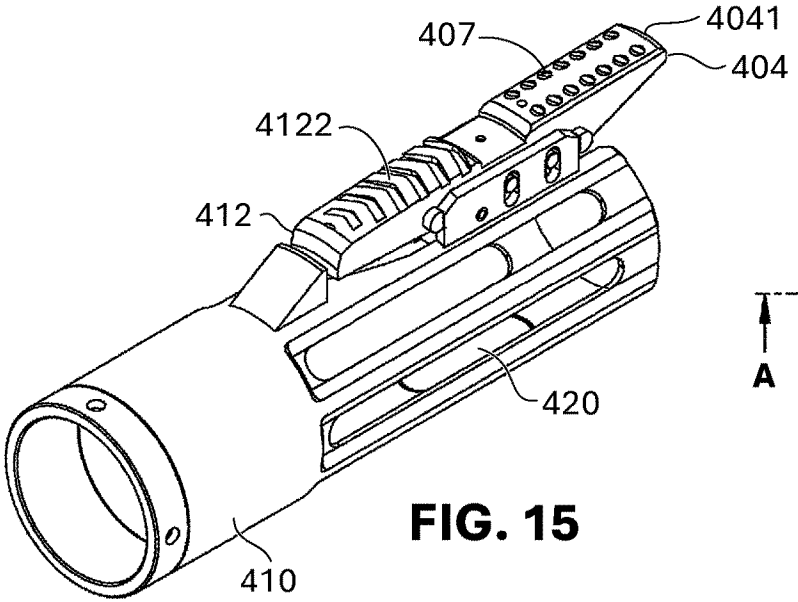
FIG. 15 is a perspective view of the anchoring tool illustrated in FIG. 11, disposed in an anchoring-effective state.
Figure 17:
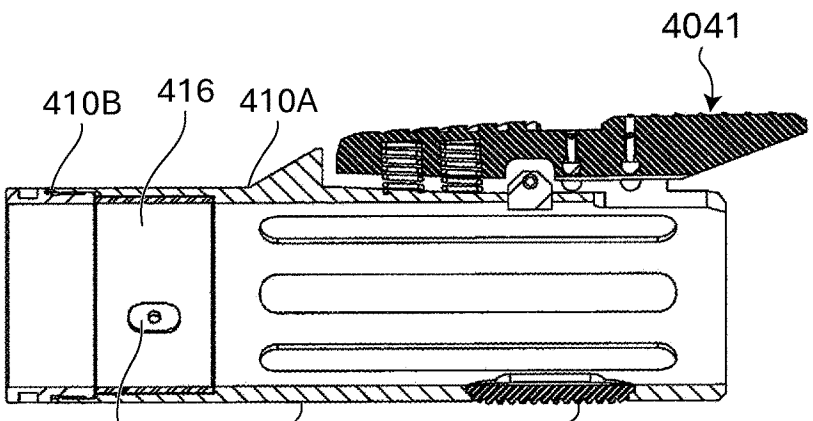
FIG. 17 is a sectional view of the anchoring tool illustrated in FIG. 15, taken along lines A-A in FIG. 16.
Figure 19A:
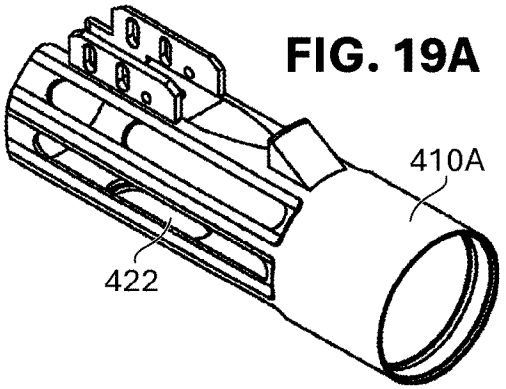
FIG. 19A is a perspective view of an embodiment of an anchor tool support of the anchoring tool illustrated in FIG. 11.
Figure 19B:
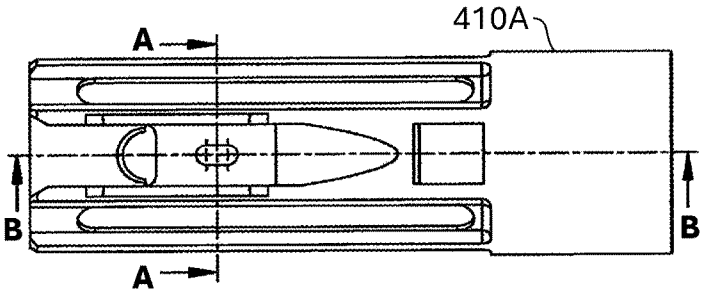
FIG. 19B is a top plan view of an embodiment of the anchor support illustrated in FIG. 19A.
Figure 19C:
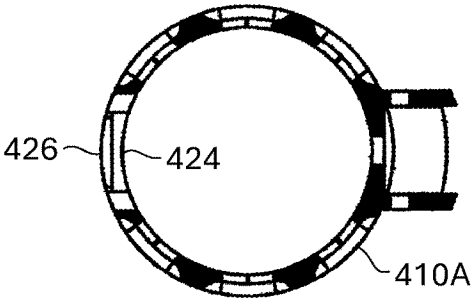
FIG. 19C is a sectional view from one end of the anchor support illustrated in FIG. 19A, taken along lines A-A in FIG. 19B.
Figure 19D:
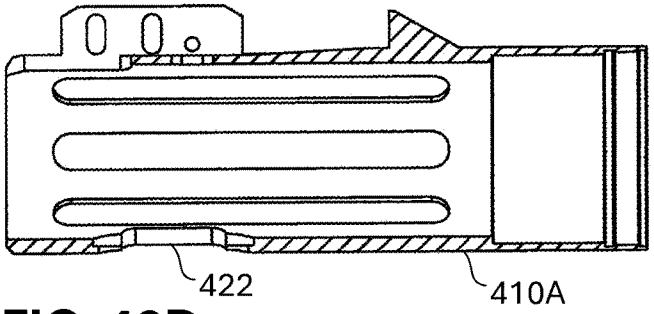
FIG. 19D is a side sectional view of the anchor support illustrated in FIG. 19A, taken along lines B-B in FIG. 19B.
Figure 19E:
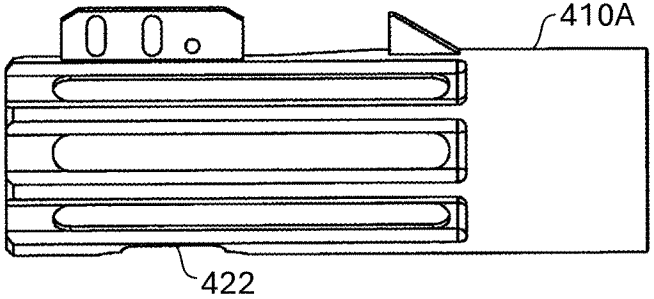
FIG. 19E is a side view of the anchor support illustrated in FIG. 19A.
Figure 19F:
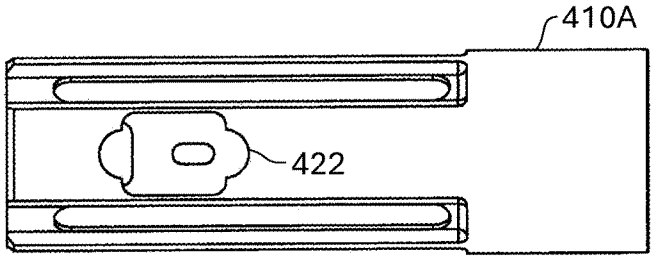
FIG. 19F is a bottom plan view of the anchor support illustrated in FIG. 19A.
Figure 20C:
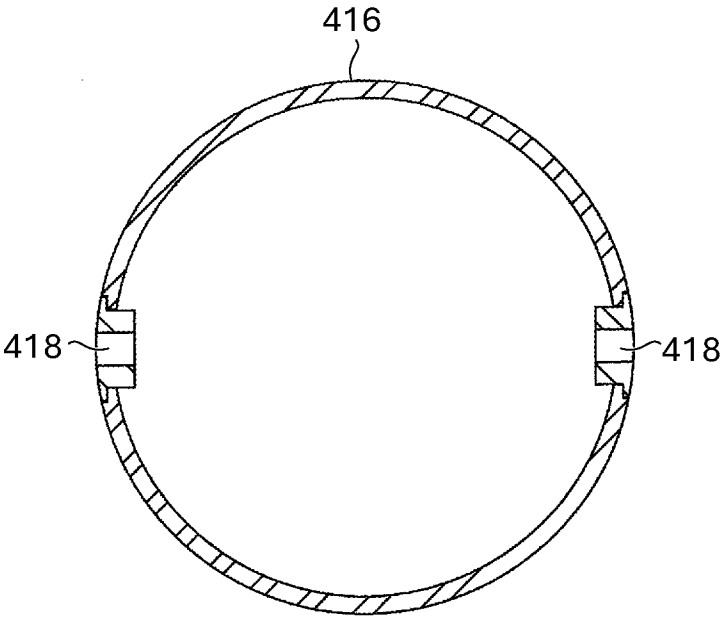
FIG. 20C is a sectional view taken from one end of the pusher illustrated in FIG. 20A, taken along lines A-A in FIG. 20B.
Figure 20B:
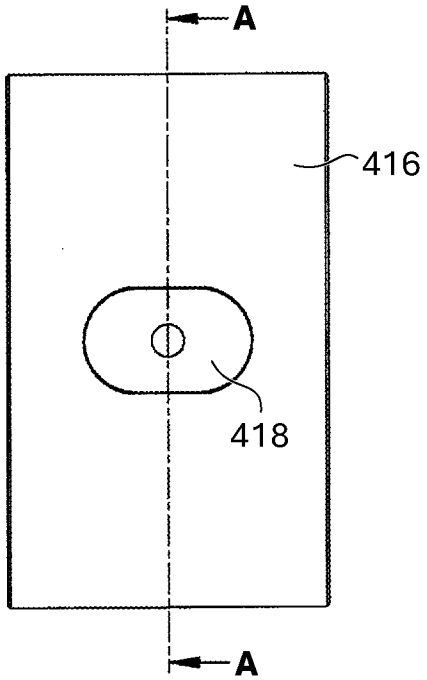
FIG. 20B is a side view of the pusher illustrated in FIG. 20A.
Figure 20A:
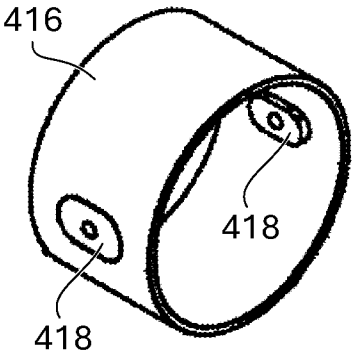
FIG. 20A is a perspective view of a pusher of the anchoring tool illustrated in FIG. 11.
Figure 24:
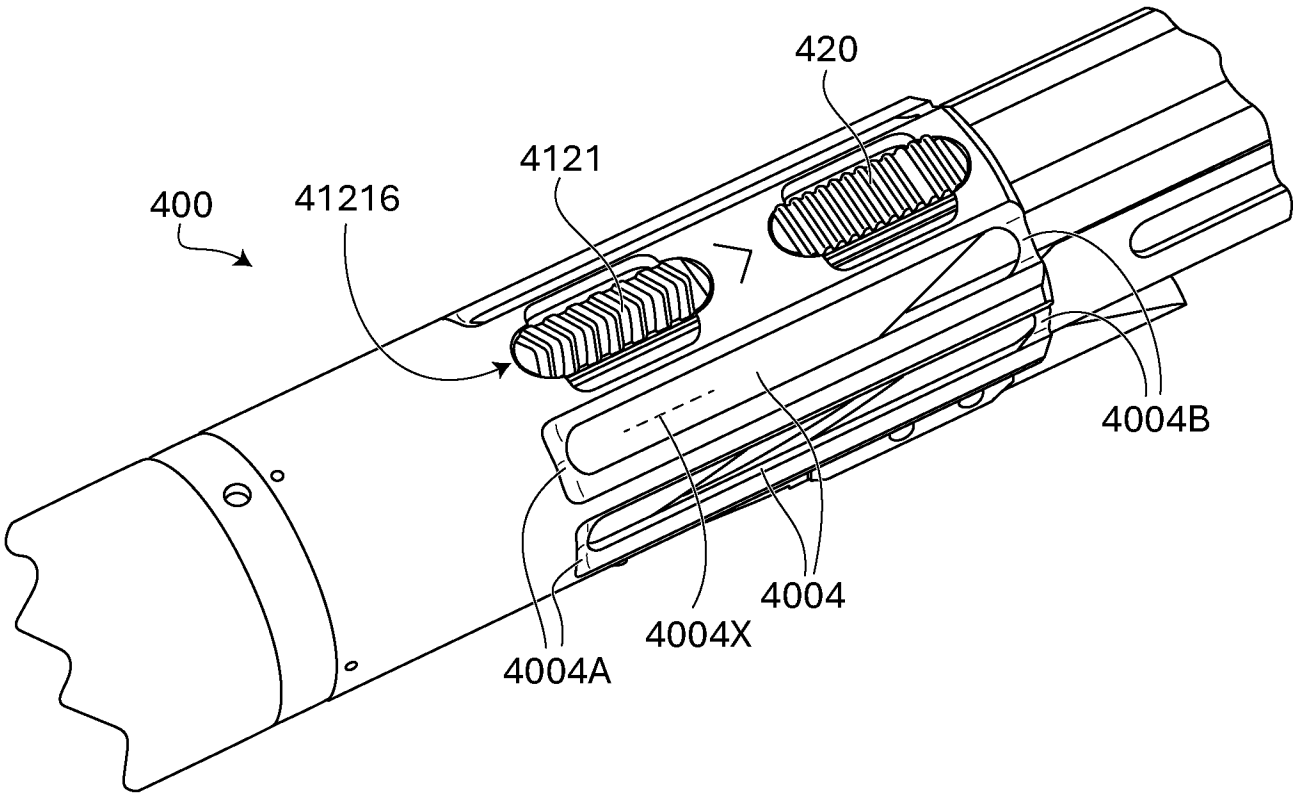
FIG. 24 is a schematic illustration of a portion of another embodiment of the anchoring tool.

Referring to FIGS. 14 and 24, in some embodiments, for example, the anchoring tool 400 includes an anchoring tool channel configuration 4002. In some embodiments, for example, the anchoring channel configuration 4002 is defined by a plurality of channels 4004. The anchoring tool channel configuration 4002 is recessed within the outermost surface 4006 of the anchoring tool mount 410. The anchoring tool channel configuration 4002 is disposed, relative to at least a subset of the anchors 404 (such as, for example, a subset that includes the anchor 4041) of the anchor configuration 402 (the "flow by area-compensated anchor configuration), in an alignment which is effective for conducting reservoir fluid past the flow-compensated anchor configuration. In some embodiments, for example, the alignment is an alignment within a plane, through which the flow by area-compensated anchor configuration extends, and whose normal axis is parallel to the central longitudinal axis of the wellbore string 104. In some embodiments, for example, the cross-sectional flow area of the anchoring tool channel configuration 4002 is at least 1.275 square inches, such as, for example, at least 1.35 square inches, such as, for example, 1.425 square inches. In some embodiments, for example, within a cross-section which is traversed by: (i) the flow by area-compensated anchor configuration, and (ii) the anchoring tool channel configuration which is disposed in an alignment (the "aligned anchoring tool channel configuration) with the flow by area-compensated anchor configuration, the ratio of, (i) the cross-sectional flow area of the aligned anchoring tool channel configuration, to (ii) the cross-sectional area, occupied by the anchoring tool 400, is at least 0.121, such as, for example, at least 0.128, such as, for example, at least 0.135.

In some embodiments, for example, and as alluded to above, the anchoring channel configuration 4002 is defined by a plurality of channels 4004. In some embodiments, for example, the channels 4004 are angularly spaced relative to one another.

Each one of the anchoring tool channels 4004, independently, is configured to conduct reservoir fluid that is flowing past the anchoring tool 400 within the wellbore. In some embodiments, for example, for each one of the channels 4004, the channel is in the form of a recess defined within the outermost surface 4006 (e.g. of the anchoring tool mount 410). In some embodiments, for example, for each one of the channels 4004, the channel is in the form of a slot defined within the outermost surface 4006. Each one of the anchoring tool channels 4004, independently, includes respective opposite ends 4004A, 4004B, and each one of the respective opposite ends 4004A, 4004B, independently, is defined by a respective end surface that tapers inwardly from the outermost surface 4006. In some embodiments, for example, this is for encouraging release of wellbore material which may become disposed within the channel 4004.

In some embodiments, for example, each one of the anchoring tool channels 4004, independently, has a depth of at least 1/16 inch, such as, for example, at least 1/12 inch, such as, for example, at least 1/8 inch. In some embodiments, for example, each one of the anchoring tool channels 4004, independently, has a length of at least three (3) inches, such as, for example, at least four (4) inches, such as, for example, at least five (5) inches.

Each one of the channels 4004, independently, has a central longitudinal axis 4004X, such that the plurality of anchoring tool channels 4004 has a corresponding plurality of longitudinal axes 4004X. In some embodiments, for example, the plurality of anchoring tool channels 4004 are co-operatively configured such that the plurality of axes 4004X are disposed in parallel relationship with one another. In some embodiments, for example, the plurality of anchoring tool channels 4004X are circumferentially spaced about the outermost surface 4006. In some embodiments, for example, the plurality of anchoring tool channels 4004 extend at least through a space disposed in circumferential alignment with the anchor configuration 402 (including the anchor 4041), and thereby at least partially compensate for the interference to flow provided by the anchor configuration 402 (including the anchor 4041). In this respect, in some embodiments, for example, each one of the channels 4004, independently, is circumferentially aligned with the laterally outwardly extending wedge-actuatable anchor configuration.

Figure 25:
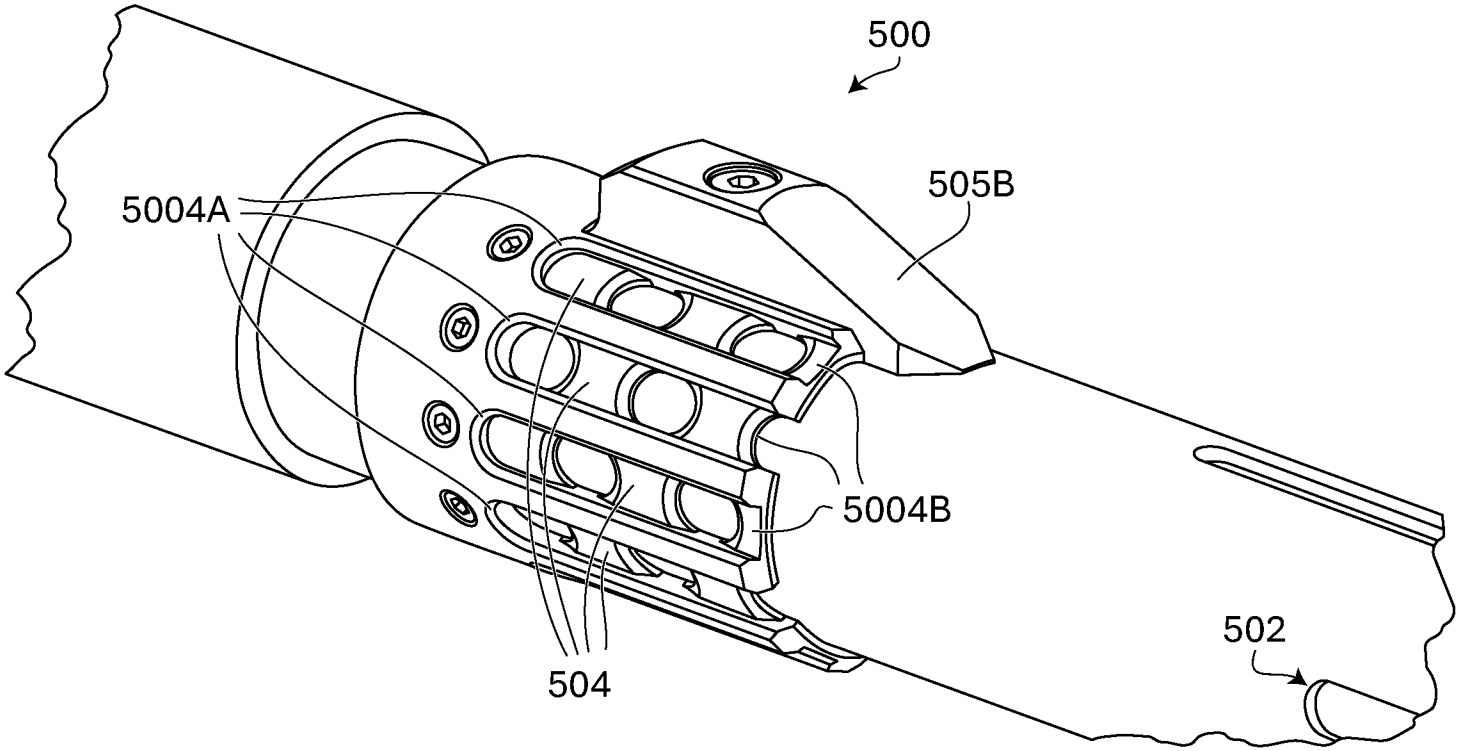
FIG. 25 is a schematic illustration of a portion of another embodiment of the actuator tool.
Figure 26:
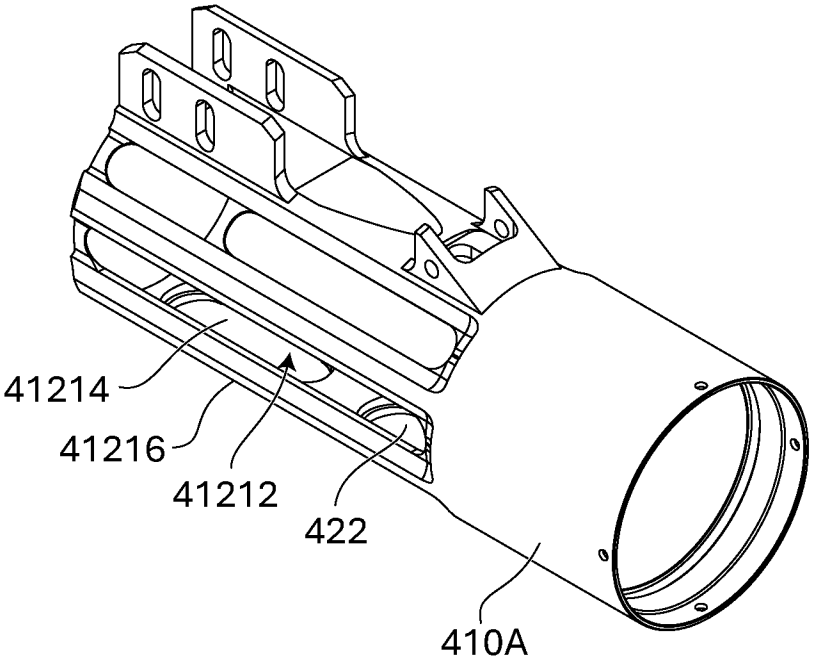
FIG. 26 is a perspective view of the anchoring tool illustrated in FIG. 24, with the anchors having been removed for clarity.

Referring to FIGS. 14 and 25, in some embodiments, for example, the actuator tool 500 includes an actuator tool channel configuration 5002. In some embodiments, for example, the actuator tool channel configuration 5002 is defined by a plurality of actuator tool channels 5004. The actuator tool channel configuration 5002 is recessed within the outermost surface 4006 of the anchoring tool mount 410. The actuator tool channel configuration 5002 is disposed, relative to at least a subset of the wedge configuration (the "flow by area-compensated wedge configuration"), defined by at least one wedge 505A, in an alignment which is effective for conducting reservoir fluid past the flow by area-compensated wedge configuration. In some embodiments, for example, the alignment is an alignment within a plane, through which the flow by area-compensated wedge configuration extends, and whose normal axis is parallel to the central longitudinal axis of the wellbore string 104.

In some embodiments, for example, and as alluded to above, the actuator tool channel configuration 5002 is defined by a plurality of channels 5004. In some embodiments, for example, the channels 5004 are angularly spaced relative to one another.

Each one of the actuator tool channels 5004, independently, is configured to conduct reservoir fluid that is flowing past the actuator tool 500 within the wellbore. In some embodiments, for example, for each one of the channels 5004, the channel is in the form of a recess defined within the outermost surface 5006. In some embodiments, for example, for each one of the channels 5004, the channel is in the form of a slot defined within the outermost surface 5006. Each one of the actuator tool channels 5004, independently, includes respective opposite ends, and each one of the respective opposite ends, independently, is defined by a respective end surface that tapers inwardly from the outermost surface 5006. In some embodiments, for example, this is for encouraging release of wellbore material which may become disposed within the channel 5004.

In some embodiments, for example, each one of the actuator tool channels 5004, independently, has a depth of at least 1/16 inch, such as, for example, at least 1/12 inch, such as, for example, at least 1/8 inch. In some embodiments, for example, each one of the actuator tool channels 5004, independently, has a length of at least three (3) inches, such as, for example, at least four (4) inches, such as, for example, at least five (5) inches.

Each one of the channels 5004, independently, has a central longitudinal axis 5004X, such that the plurality of actuator tool channels 5004 has a corresponding plurality of longitudinal axes 5004X. In some embodiments, for example, the plurality of actuator tool channels 5004 are co-operatively configured such that the plurality of axes 5004X are disposed in parallel relationship with one another. In some embodiments, for example, the plurality of actuator tool channels 5004X are circumferentially spaced about the outermost surface 5006. In some embodiments, for example, the plurality of actuator tool channels 5004 extend at least through a space disposed in circumferential alignment with the laterally outwardly extending wedge configuration, and thereby at least partially compensate for the interference to flow provided by the laterally outwardly extending wedge configuration. In this respect, in some embodiments, for example, each one of the channels 5004, independently, is circumferentially aligned with the laterally outwardly extending wedge configuration.

In some embodiments, for example, the wellbore string engagement configuration 401 also includes a drag block configuration 410 that is defined by at least one drag block 412. Each one of the at least one drag block 412, independently, defines a wellbore string-engaging surface configured for frictionally resisting axial movement, through the wellbore 102, of the anchoring tool 400 relative to the wellbore string 104. In some embodiments, for example, for each one of the at least one drag block 412, independently, the drag block 412 is co-operable with the wellbore string 104, such that, while the anchoring assembly 300 is coupled to a flow conductor 200 that is disposed within the wellbore 102 that is lined with the wellbore string 104, the drag block 412 is biased for displacement towards the wellbore string 104 for effecting contact engagement of the drag block 412 with the wellbore string 104, with effect that axial movement of the anchoring tool 400 is frictionally resisted. In some embodiments, for example, each one of the anchors 404, of the anchor configuration 402, is aligned with a corresponding one of the at least one drag block 412, of the drag block configuration 410, along a longitudinal axis of the anchoring tool 400, such that a plurality of anchor/drag block configurations are established.

Referring to FIGS. 8 to 18, in some embodiments, for example, and as alluded to above, the rocker 408 also defines the drag block 412, such that for at least one of the anchor/drag block configurations, independently, the anchor 404 is defined by a rocker 4081 which includes a pair of pads, the uphole one of the pads is defined by an anchor 4041, and the other pad is defined by the counterpart drag block 412, and the biasing of the drag block 412 (into the contact engagement with the wellbore string 104, such as, for example, for purposes of scraping the casing, as further explained below) is effectuated by the biasing member 413. In this respect, in some embodiments, for example, the rocker 408 is a "rocker slip drag block". In those embodiments where the rocker 408 is a rocker slip drag block, in some of these embodiments, for example, in response to defeating of the biasing of the drag block 412, such as that effected by the actuation of the anchor 4041 by the actuator tool 500, effects the retraction of the drag block 412 from the wellbore string 104, such that the contact engagement between the drag block/casing scraper 4122 and the wellbore string 104 is defeated, thereby mitigating interference to the anchoring of the corresponding anchor 404 of the rocker 408. In this respect, in parallel with actuation of the anchor 4041, the drag block 412 of the rocker 4081 becomes retracted.

Referring to FIGS. 28 to 36, in some embodiments of the anchor/drag block configurations, the wedge-actuatable anchor 4041 is a drag block-independent anchor 4042, such that at least one drag block-independent anchor/drag block configuration is established (and, in some embodiments, for example, the at least one drag block-independent anchor/drag block configuration is a single drag block-independent anchor/drag block configuration only). For each one of the at least one drag block-independent anchor/drag block configuration, independently, the respective anchor is a drag block independent anchor 4042. For each one of the at least one drag block-independent anchor/drag block configuration, independently, the respective drag block independent anchor 4042 and the respective drag block 412 are co-operatively configured such that there is an absence of resistance to the actuation of the drag block-independent anchor 4042 by the biasing force which is biasing the respective drag block 412 into the contact engagement with the wellbore string 104. In some of these embodiments, for example, the drag block 412 is biased into the contact engagement with a biasing configuration 4131 (e.g. at least one biasing member (e.g. spring member)), and the drag block-independent anchor 4042 is biased to retraction from the wellbore string 104 with a biasing configuration 4132 (e.g. at least one biasing member (e.g. spring member), and the biasing configuration 4131 has a stronger biasing force than the biasing configuration 4132. In some embodiments, for example, the ratio of the biasing force of the biasing configuration 4131 to the biasing force of the biasing configuration 4132 is greater than 5:1, such as, for example, greater than 7.5:1, such as, for example, greater than 10:1. In some embodiments, for example, the drag block 412, the biasing configuration 4131, and the wellbore string 104 are co-operatively configured such that, while the anchoring tool 400 is being axially moved relative to the wellbore string 104, the drag block 412 is applying a drag force within a range, and the range is from 40 pounds to 60 pounds, and the biasing force of the biasing configuration is at least 10 pound-force.

Figure 32:
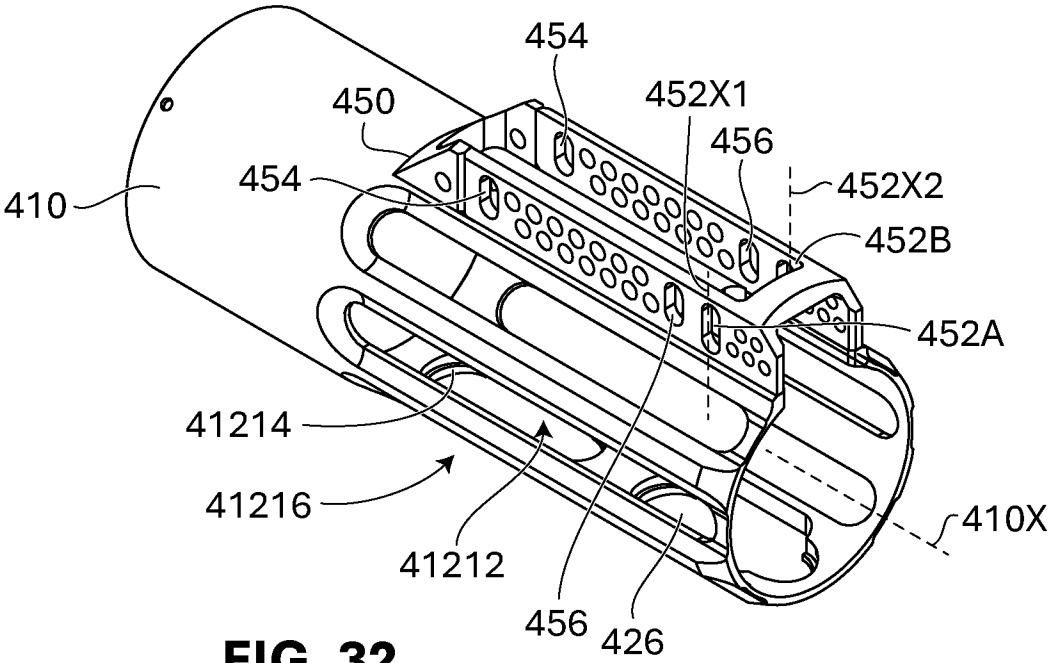
FIG. 32 is a top perspective view of the mandrel of the anchoring tool of the anchoring assembly illustrated in FIG. 28.
Figure 33:
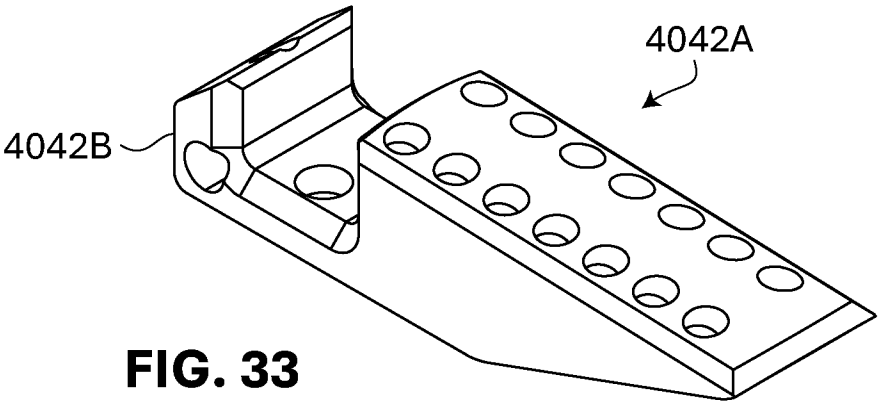
FIG. 33 is a top perspective view of a mechanical slip of the anchoring assembly illustrated in FIG. 28.
Figure 34:
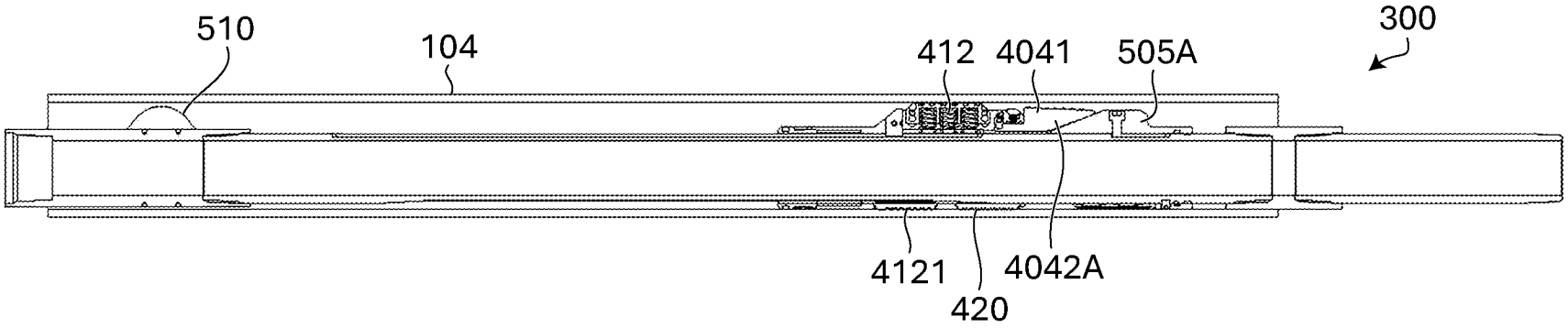
FIG. 34 is a cut-away side view of a casing within which the anchoring assembly (shown in sectional side view), illustrated in FIG. 28, is disposed and has begun transitioning from an anchoring-ineffective state to the anchoring effective state.
Figure 35:
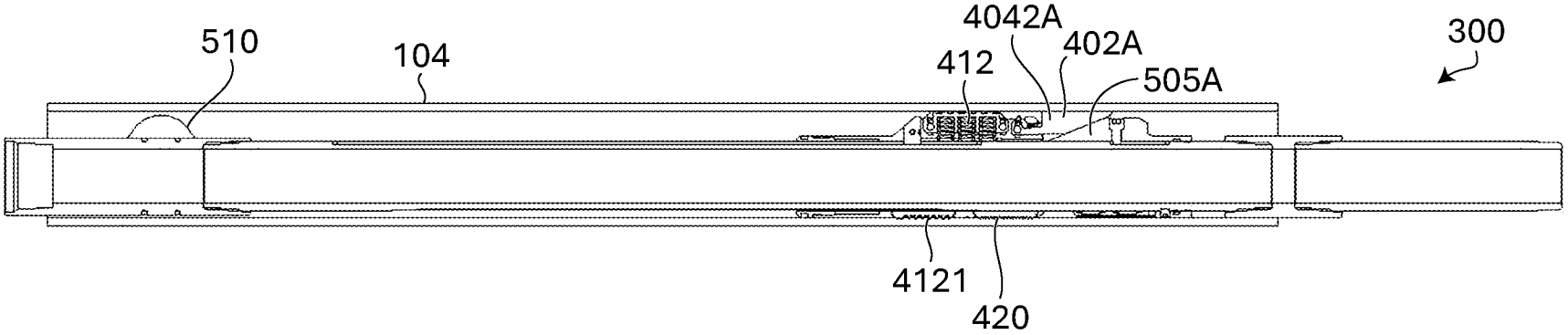
FIG. 35 is a cut-away side view of a casing within which the anchoring assembly (shown in sectional side view), illustrated in FIG. 28, is disposed in the anchoring effective state.
Figure 36:
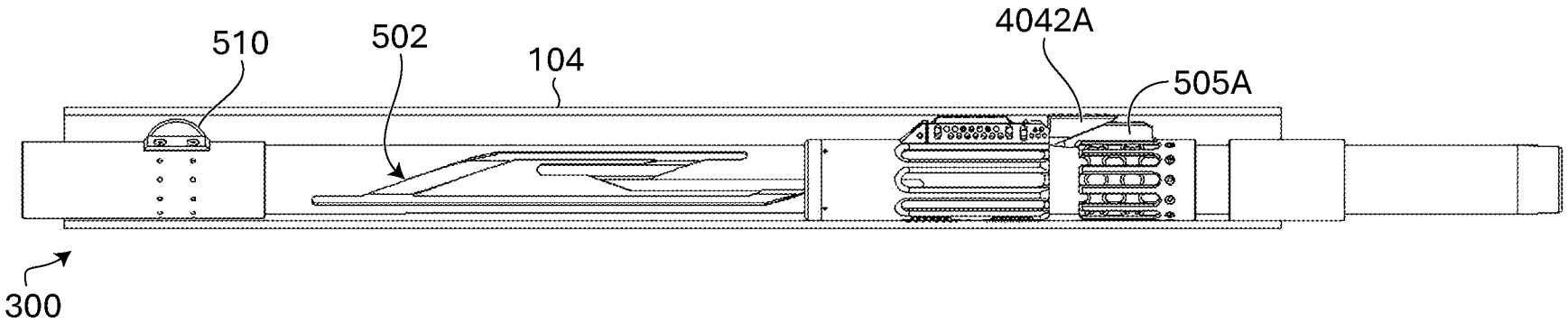
FIG. 36 is a is a cut-away side view of a casing within which the anchoring assembly, illustrated in FIG. 28, is disposed in the anchoring effective state.

Referring to FIGS. 32 and 33, for each one of the at least one drag block-independent anchor/drag block configuration, independently, the respective drag block independent anchor 4042 is a mechanical slip 4042A that is coupled at a first end 4042B to a carrier 450 of the anchoring tool 400 via slots 452A, 452B that extends laterally relative to the central longitudinal axis 410X of the anchoring tool mount 410 (and, in some embodiments, for example, the central longitudinal axis 200X of the flow conductor 200). In some embodiments, for example, for each one of the slots 452A, 452B, the central longitudinal axis 452X1, 452X2 of the slot is perpendicular relative to the central longitudinal axis 410X of the anchoring tool mount 410 (and, in some embodiments, for example, the central longitudinal axis 200X of the flow conductor 200).

The coupling is with effect that the mechanical slip 4042A is displaceable through the slot 452 in a laterally outwardly direction relative to the central longitudinal axis 410X of the anchoring tool mount 410 (and, in some embodiments, for example, the central longitudinal axis 200X of the flow conductor 200). The transitioning of the anchoring assembly from the actuator-ineffective state to the actuator-effective state is effectuated in response to the laterally outwardly displacement of the mechanical slip 4042A, relative to the central longitudinal axis 410X of the anchoring tool mount 410 (and, in some embodiments, for example, the central longitudinal axis 200X of the flow conductor 200), which is motivated by the wedging, of the respective wedge 505A between the anchor 4041 and the outermost surface 4006 of the anchoring tool mount 410. In some embodiments, for example, the displacement also includes a rotational displacement, of the mechanical slip 4042A, such as, for example, a rotational displacement about an axis that is perpendicular to the central longitudinal axis 410X of the anchoring tool mount 410 (and, in some embodiments, for example, that is perpendicular to the central longitudinal axis 201X of the flow passage 201 of the flow conductor 200). In some embodiments, for example, the displacement of the mechanical slip 4042A in a laterally outwardly direction, relative to the central longitudinal axis 410X of the anchoring tool mount 410, is with effect that the wellbore string engaging surface 406 becomes engaged to the wellbore string 104. In some of these embodiments, for example, the engagement, between the wellbore engaging surface 406 and the wellbore string 104, is over an interfacial area that is defined by a total axial length (measured along an axis that is parallel to the central longitudinal axis 104X of the passage 1041 defined by the wellbore string 104) of at least two (2) inches, such as, for example, at least 2.8 inches, such as, for example, at least four (4) inches. In some of these embodiments, for example, the wellbore engaging surface 406 is disposed in flush engagement with the wellbore string 104.

Relatedly, for each one of the at least one drag block-independent anchor/drag block configuration, independently, the respective drag block 412 is coupled to the carrier 450 via slots 454, 456. In this respect, the drag block 412 is extendible and retractable, relative to the actuator tool mount 602, along an axis that is perpendicular to the central longitudinal axis of the actuator tool mount 602.

Referring to FIGS. 24, 26, 31, and 32, in some embodiments, for example, for at least one of the anchor/drag block configurations, independently, the anchor 404 is a cavity-retained anchor 420 and there is associated a counterpart drag block 412 defined by a cavity-retained drag block 4121. In some embodiments, for example, the cavity-retained drag block 4121 is aligned with the cavity-retained anchor 420 along a longitudinal axis of the anchoring tool 400, such that at least one of the anchor/drag block configurations includes an anchor/drag block configuration defined by a cavity-retained anchor 420 and its counterpart cavity-retained drag block 4121. For each one of the at least one cavity-retained drag block 4121, independently, the anchoring tool 400 defines a respective drag block-retaining cavity 41212, a respective actuator tool communicator 41214, and a respective casing communicator 41216. For each one of the at least one cavity-retained drag block 4121, independently, the cavity-retained drag block 4121, the respective drag block-retaining cavity 41212, the respective actuator tool communicator 41214, and the respective casing communicator 41216 are co-operatively configured such that the cavity-retained drag block 4121 is retained to the anchoring tool mount 410 within the respective drag block-retaining cavity 41212, and, while the anchoring assembly 300 is disposed within the wellbore 102 lined with the casing 102, the cavity-retained drag block 4121, the respective drag block-retaining cavity 41212, the respective actuator tool communicator 41214, and the respective casing communicator 41216 are co-operable with an actuator tool 500 disposed within the wellbore 102, such that, while the actuator tool 500 is disposed in contact engagement with the cavity-retained drag block 4121 through the respective actuator tool communicator 41214 and the actuator tool 500 is being pulled in the uphole direction, the cavity-retained drag block 4121 is urged by the actuator tool 500 into contact engagement with the wellbore string 104 via the respective casing communicator 41216. In some embodiments, for example, the cavity-retained drag block 4121 is coupled to the anchoring tool mount 410 via containment within the cavity 41212 only. In some of these embodiments, for example, the cavity-retained drag block 4121 is floating within the cavity 422.

In some embodiments, for example, for each one of the anchor/drag block configurations, independently, the drag block 412 is a drag block/casing scraper 4122, and the wellbore string-engaging surface of the drag block/casing scraper 4122 includes a blade configuration defined by at least one blade (in the illustrated embodiment, the at least one blade is a plurality of v-shaped blades) for engaging the wellbore string 104 for effecting conditioning the wellbore string 104. In some embodiments, for example, the conditioning is with effect that debris (e.g. corrosion and/or scale) is removed from an unconditioned surface portion of the wellbore string 104, with effect that a conditioned surface portion of the wellbore string 104 is obtained. In this respect, in some embodiments, for example, the conditioning of the surface portion of the wellbore string 104 is for improving the reliability of anchoring of the flow conductor 200 to the wellbore string 104 via the anchor 404. In some embodiments, for example, the scraping and the anchoring are effected during a single trip. In some embodiments, for example, the drag block/scraper 4122 is spaced apart from the anchor 404 by a minimum distance of less than five (5) feet, such as, for example, less than 2½ feet, such as, for example, less than 12 inches. In some embodiments, for example, the biasing of the drag block/casing scraper 4122 towards the wellbore string 104 is for effecting contact engagement of the drag block/casing scraper 4122 with the wellbore string 104, such that, while the drag block/casing scraper 4122 is disposed in contact engagement with the wellbore string 104, and the anchoring assembly 300 is being axially displaced through the wellbore, the scraping of the casing portion is being effectuated.

In some embodiments, for example, the anchors 404 (such as, for example, the wedge-actuatable anchor 4041 and the single cavity-retained anchor 420) are circumferentially spaced relative to one another. The anchoring tool 400 is co-operable with the wellbore string 104 such that, while the anchoring assembly 300 is integrated within the flow conductor 200, that is disposed within the wellbore string 104, and is disposed in the anchoring-effective state, the transitioning to the anchoring-effective state is with effect that each one of the plurality of anchors 404, independently, becomes displaced outwardly relative to the central longitudinal axis of the flow conductor 200, such that the anchoring of the flow conductor 200 to the wellbore string 104 is established, and while the anchoring of the flow conductor 200 to the wellbore string 104 is established, for each adjacent pair of anchors 104, independently, the anchors 104 are spaced apart by a minimum distance of at least 0.5 inches.

In some embodiments (such as the illustrated embodiments), for example, the anchoring tool 400 is co-operable with the wellbore string 104 such that, while the anchoring assembly 300 is integrated within the flow conductor 200, that is disposed within the wellbore string 104, and is disposed in the anchoring-effective state, the anchoring tool mount 410 (and, therefore, the flow conductor 200) becomes eccentrically disposed relative to the central longitudinal axis of the wellbore 102. In some of these embodiments, for example, the eccentric disposition of the flow conductor 200 relative to the central longitudinal axis of the wellbore 102 is such that a ratio of a minimum distance "D1", by which the central longitudinal axis of the flow conductor 200 is spaced apart from the wellbore string 104, to a minimum distance "D2", by which the central longitudinal axis of the wellbore 102 is spaced apart from the wellbore string 104, is less than 0.2, such as, for example, less than 0.175.

In this respect, in some embodiments, for example, the plurality of anchors 404 includes a pair of adjacent anchors 104, and the adjacent anchors 104 is a first anchor and a second anchor (such as, for example, the anchors 4041, 420), and the first anchor 4041 is disposed on an opposite side of the flow conductor 200 relative to a side of the flow conductor 200 on which the second anchor 420 is disposed. The anchoring tool 400 is co-operable with the wellbore string 104 such that, while the anchoring assembly 300 is integrated within the flow conductor 200, that is disposed within the wellbore string 104, and is disposed in the anchoring-effective state, the transitioning to the anchoring-effective state is with effect that each one of the first and second anchors 4041, 420, independently, becomes displaced outwardly relative to the central longitudinal axis of the flow conductor 200, such that the anchoring of the flow conductor 200 to the wellbore string 104 is effectuated, and a ratio of the outward displacement of the first anchor 4041 to the outward displacement of the second anchor 420 is at least 2.5, such as, for example, at least 3.0, and the anchoring is with effect that the anchoring tool mount 410 (and, therefore, the flow conductor 200) becomes eccentrically disposed relative to the central longitudinal axis of the wellbore string 104.

In some embodiments, for example, within a plane which traverses the anchor configuration (e.g. the flow by area-compensated anchor configuration), the cross-sectional area, occupied by the anchoring tool 400, is less than 12.5 square inches, such as, for example, less than 12 square inches, such as, for example, less than 11.5 square inches, such as, for example, less than 11 inches.

In some embodiments, for example, the anchoring assembly 300 further includes a spacer 510.

In some embodiments, for example, the anchor configuration 402 and the spacer 510 are co-operable with the wellbore string 104 such that, while the anchoring assembly 300 is integrated within the flow conductor 200, that is disposed within the wellbore string 104, and is disposed in the anchoring-effective state, displacement, of the anchoring tool mount 410, relative to the central longitudinal axis of the wellbore string 104, being urged by an application of a tensile force to the anchoring assembly 300 in the uphole direction, and which is sufficient to defeat the anchoring, is resisted, and, in some embodiments, for example, is prevented.

In some embodiments, for example, the anchor configuration 402 and the spacer 510 are co-operable with the wellbore string 104 such that, while the anchoring assembly 300 is integrated within the flow conductor 200, that is disposed within the wellbore string 104, and is disposed in the anchoring-effective state, a change in orientation, of the anchor configuration 402, relative to the wellbore string 104, being urged by application of a tensile force to the anchoring assembly 300 in the uphole direction, and which is sufficient to effectuate emplacement of the anchor configuration 402 in an angled orientation, relative to the wellbore string 104, is resisted, such as, for example, in some embodiments, prevented. In some embodiments, for example, the change in orientation is sufficient to effect defeating of the flush engagement between the anchor configuration 402 and the wellbore string 104.

In some embodiments, for example, the anchor configuration 402 and the spacer 510 are co-operable with the wellbore string 104 such that, while the anchoring assembly 400 is integrated within the flow conductor 200, that is disposed within the wellbore string 104, and while the transitioning is being effected, emplacement of the anchor configuration 402, at an angled orientation (e.g. a non-flush orientation) relative to the wellbore string 104, is resisted (such as, for example, prevented), such that the transitioning is with effect that:

the anchor configuration 402 becomes disposed further outwardly, relative to the central longitudinal axis of the anchoring tool mount 410, than in the anchoring-ineffective state; and the anchor configuration 402 becomes engaged to the wellbore string 104 such that the anchor configuration 402 is disposed in flush engagement with the wellbore string 104 and the anchoring of the flow conductor 200 to the wellbore string 104 is established.

In some embodiments, for example, the above-described co-operation of the anchor configuration 402 and the spacer 510, with the wellbore string 104 is such that the wellbore string 104 interferes with outwardly displacement of the spacer 510 relative to the central longitudinal axis of the wellbore string 104.

In some embodiments, for example, the spacer 510 extends outwardly from the outermost surface 604 of the actuator tool mount 602. In some embodiments, for example, the spacer 510 extends outwardly from the outermost surface 604, along an axis that is perpendicular to the central longitudinal axis of the actuator tool 500, by a distance of at least 0.5 of an inch, such as, for example, at least 0.75 of an inch, such as, for example, at least one (1) inch.

In some embodiments, for example, the spacer is spaced apart from the mechanical slip 4042A by a total axial distance (measured along an axis that is parallel to the central longitudinal axis 410X of the anchoring tool mount 410) of at least 20 inches, such as, for example, at least 30 inches, such as, for example, at least 40 inches.

In some embodiments, for example, the actuator tool 500 extends through the anchoring tool mount 410 of the anchoring tool 400, such that the actuation of the anchoring tool 400 by the actuator tool 500 is effectuated by axial movement of the actuator tool 500 through the anchoring tool mount 410. The actuation of the anchoring configuration 404 by the actuator tool 500 is effectuated by co-operation of the j-slot configuration 502 and the anchoring tool 400, while the actuator tool 500 is being pulled uphole within the wellbore 102.

In this respect, and referring to FIG. 17 and FIGS. 20A-C, the anchoring tool 400 further includes a pusher 416 for effecting the co-operation between the j-slot configuration 502 and the anchoring tool 400. The pusher 416 and the wellbore string engagement configuration 401 are co-operatively coupled such that: (i) the wellbore string engagement configuration 401 is movable with the pusher 416, and (ii) the pusher 416 is rotatable relative to the wellbore string engagement configuration 401. In this respect, the pusher 416 and the wellbore string engagement configuration 401 are independently rotatable. In some embodiments, for example, the pusher 416 is contained within the anchoring tool mount 410. In this respect, in some embodiments, for example, the anchoring tool mount 410 includes an anchor support 410A, for supporting the wellbore string engagement configuration 401 (for example, the rotatable mounting of the rocker 408 to the anchoring tool mount 410 is defined by the rotatable mounting of the rocker 408 to the support 410A), a retainer 410B, and the pusher 416. The retainer 410B is threadably coupled to the anchor support 410A, and the pusher 416 is disposed between the anchor support 410A and the retainer 410B. The anchor support 410A, the retainer 410B, and the pusher 416 are co-operatively configured such that the threadable coupling of the retainer 410B to the anchor support 410A defines space sufficient for retention of the pusher 416 between the retainer 410B and the support 410A such that axial movement of the pusher 416 relative to the retainer 410B and the support 410A is restricted while, in parallel, the pusher 416 is free to rotate relative to the threadably coupled retainer 410B and support 410A. By providing that the pusher 416 is independently rotatable of the wellbore string engagement configuration 401, application of torque to the wellbore string engagement configuration 401, during rotation of the pusher 416, is mitigated.

In some embodiments, for example, the pusher 416 includes at least one guide pin 418. Each one of the at least one guide pin 418, independently, is configured for travel within a respective one of the at least one j-slot 503 of the j-slot configuration 502. In the illustrated embodiment, the pusher includes two (2) guide pins 418, each corresponding to a respective one of two (2) j-slots 503 defined within the actuator tool 500. In this respect, while the actuator tool 500 is moved relative to the anchoring tool 400, as the flow conductor 200 is either being moved uphole or downhole within the wellbore 102, for each one of the at least one guide pin 418, while the guide pin 418 is disposed intermediate the termini of the respective j-slot 503, because of resistance effectuated by the drag block configuration 410, the guide pin 418 is traversed by the respective j-slot 503 until becoming disposed in abutting engagement with a terminus within the j-slot 503.

Figure 22:
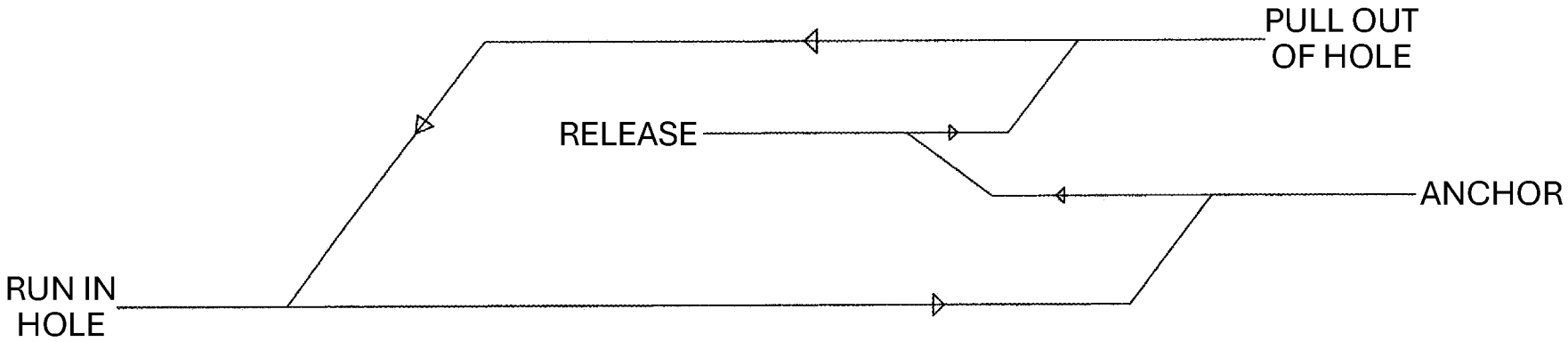
FIG. 22 is identical to FIG. 21C, and identifies the various positions within a j-slot of the mandrel.
Figure 23:
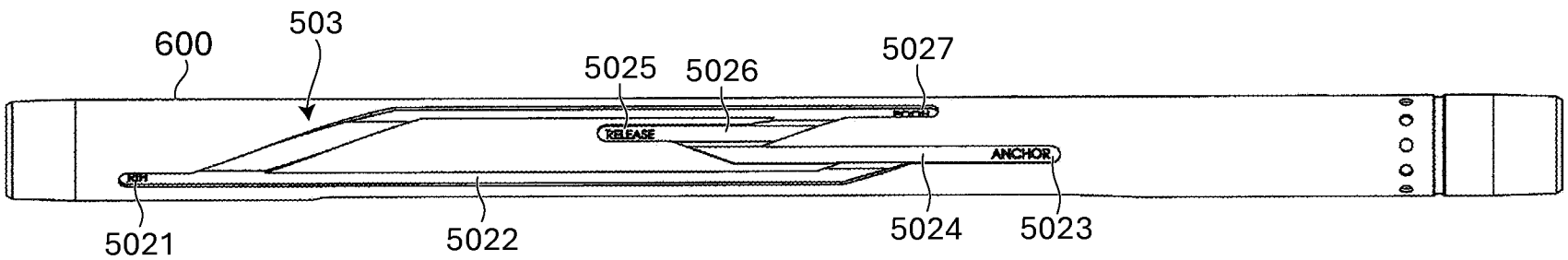
FIG. 23 is a schematic illustration of a representation of the path taken by a key of the pusher through the j-slot illustrated in FIG. 22, including the positions during the "run-in-hole" mode, the "anchor" mode, the "release" mode, and the "pull-out-of-hole" mode.

Referring to FIGS. 22 and 23, during run-in-hole mode, the guide pin 418 is disposed in abutting engagement with a terminus within the j-slot 503, and the downhole force being applied to the actuator tool 500 is transmitted to the guide pin 418 and, therefore, the pusher 416, via the j-slot 503, such that the anchoring tool 400 moves downhole with the flow conductor 200 via the actuator tool 500. During the pull-out-of-hole mode, the guide pin 418 is disposed in abutting engagement with a terminus within the j-slot 503, and the uphole force being applied to the actuator tool 500 is transmitted to the guide pin 418 and, therefore, the pusher 416, via the j-slot 503, such that the anchoring tool 400 moves uphole with the flow conductor 200 via the actuator tool 500. In those sections of the j-slot 503 which are angled relative to the longitudinal axis of the pusher 416, the transmitted force causes rotation of the pusher 416, relative to the wellbore string engagement configuration 401, while axial displacement of the pusher 416 and, therefore, the actuating mandrel 400, is resisted by the drag block configuration 410. The length of one section 5022 of the j-slot 503 is longer than another section 5026 of the j-slot so as to, in the case of section 5022, effectuate deliberate actuation of the anchoring assembly 300, and, in the case of section 5026, deliberately avoid actuation of the anchoring assembly 300.

To establish the anchoring of the flow conductor 200 to the wellbore string 104 with the anchoring tool 400, initially, the fluid conductor 200 is run-in-hole through the wellbore 102 to a desired depth ("run-in-hole" mode). During the run-in-hole mode, because of the resistance to displacement by the drag block configuration 410, each one of the guide pins 418 of the pusher 416, independently, is disposed, or becomes disposed, in a terminus 5021 of the respective j-slot 503. As such, during the run-in-hole mode, the anchor configuration 402 is disposed in a spaced apart relationship relative to the inclined surface configuration 504, such that there is an absence of actuation of the anchors 404 during the run-in-hole mode. After the flow conductor 200 becomes emplaced at the desired depth within the wellbore 102, the flow conductor 200 is pulled uphole during an "anchor mode", with effect that the flow conductor 200 is displaced relative to the anchoring tool 400, whose drag blocks 412 are resisting uphole movement, such that each one of the guide pins 418, of the pusher 416, independently, travels through the j-slot section 5022. The relative displacement, caused by the pulling up of the flow conductor 200, is continued until each one of the guide pins 418, of the pusher 416, independently, become emplaced within the terminus 5023. Such displacement of the flow conductor 200, relative to the anchoring tool 400 is sufficient to eliminate the spacing between the ramps 505A, 505B and the anchors 404, with effect that the ramps 505A, 505B engage and urge the actuation of the anchors 404, such that the flow conductor 202 becomes anchored to the wellbore string 104 by the anchors 404. At some point, it may be desirable to release the actuation of the anchors 404 so as to, for example, pull the flow conductor 200 from the wellbore 102. In that case, to release the anchors 404, the flow conductor 200 is run-in-hole again, thereby retracting the ramps 505B, 505A from the anchors 404 and effecting retraction the anchors 404 from engagement to the wellbore string 104 during a "release" mode. The retraction of the anchors 404 is confirmed once the guide pins 418, each having travelled through section 5024 of the respective j-slot 503, by virtue of the frictional resistance of the drag block configuration 410, bottom out against the terminus 5025 of the respective j-slot 503. In order to pull the flow conductor 200 from the wellbore 102 in the "pull-out-of-hole" mode, the flow conductor 200 is pulled uphole, with the frictional resistance of the drag block configuration 410 causing each one of the guide pins 418, independently, to travel through a j-slot section 5026 of the respective j-slot 503, until bottoming out against the terminus 5027. The terminus 5027 is deliberately positioned uphole relative to the terminus 5023, so as to avoid resetting of the anchors 404. As the flow conductor 200 is pulled uphole, the anchoring tool 400 is also pulled uphole, by virtue of the disposition of the guide pins 418 within the terminus 5027 of the j-slots 503.

In some embodiments, for example, it is preferable to avoid actuation of the anchors 404 in response to the application of the force in the uphole direction where it is intended to displace the flow conductor 200 in the uphole direction for coupling a joint to the flow conductor during assembly of the flow conductor, while the anchoring assembly 300 is already coupled to the flow conductor 200 and disposed downhole within the wellbore 102. Actuating the anchors 404 in these circumstances would interfere with the assembly of the flow conductor 200.

To avoid undesirable actuation of the anchors 404 in these circumstances, the length of the run in hole section portion 5022 of each one of the at least one j-slot 503, independently, is of sufficient length to enable sufficient displacement of the actuator tool 500 relative to the anchoring tool 400 such that, while the flow conductor 200 is being assembled, actuation of the anchors 404 by the actuator tool 500 is avoided. In some embodiments, for example, the length of the run in hole section portion 5022 of each one of the at least one j-slot 503 is greater than a length by which the flow conductor is lifted for coupling of an additional joint of tubing during assembly of the flow conductor 200. In some embodiments, for example, the length of the run in hole section portion 5022 of each one of the at least one j-slot 503 is at least 25% greater than the lift length, such as, for example, at least 50% greater, such as, for example, at least 75% greater, such as, for example, at least 100% greater. In some embodiments, for example, the length of the run in hole section portion 5022 of each one of the at least one j-slot 5022, independently, is greater than 12 inches, such as, for example, greater than 16 inches, such as, for example, greater than 20 inches.

Figure 21D:
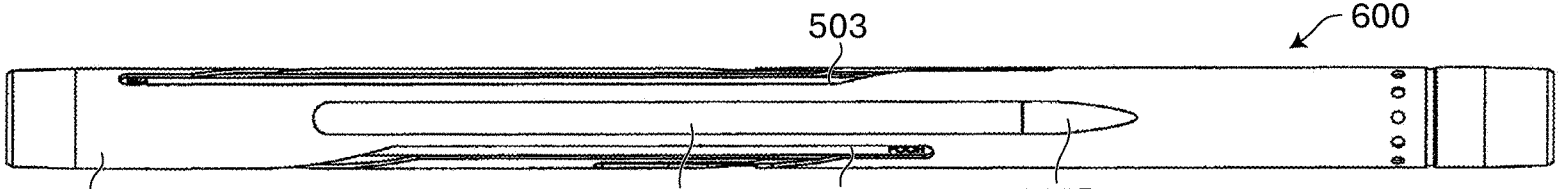
FIG. 21D is a bottom plan view of the mandrel illustrated in FIG. 21B.
Figure 27:
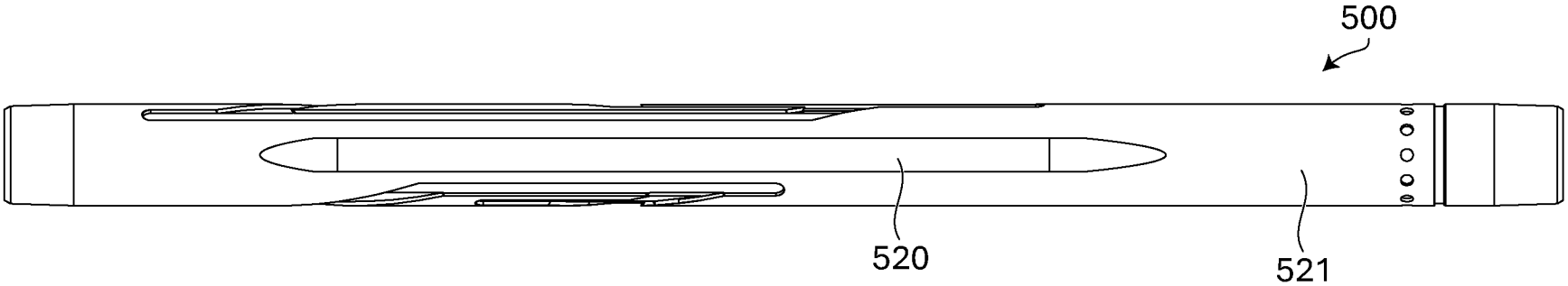
FIG. 27 is a side view of another embodiment of a mandrel.
Figure 28:
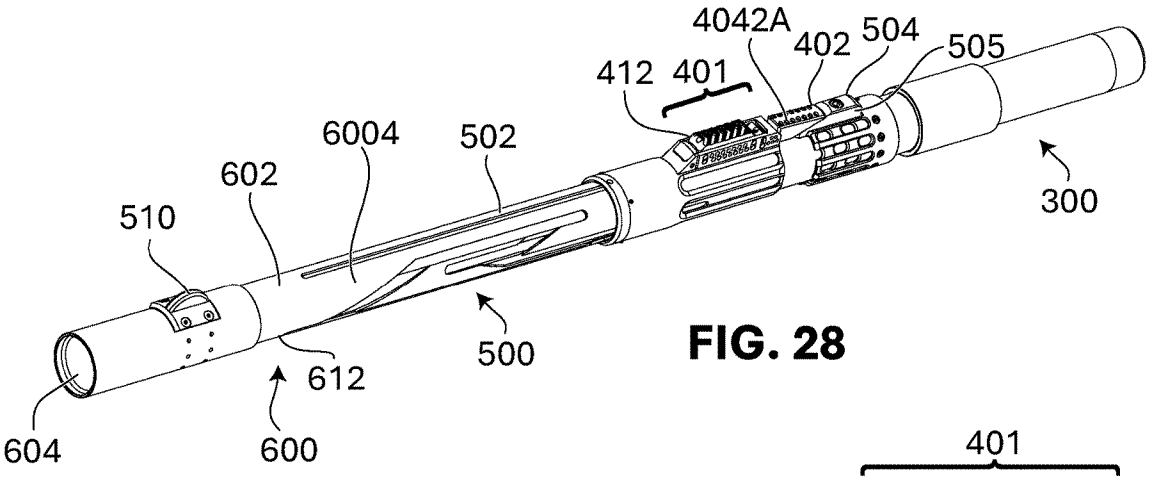
FIG. 28 is a top perspective view of another embodiment of an anchoring assembly.
Figure 29:
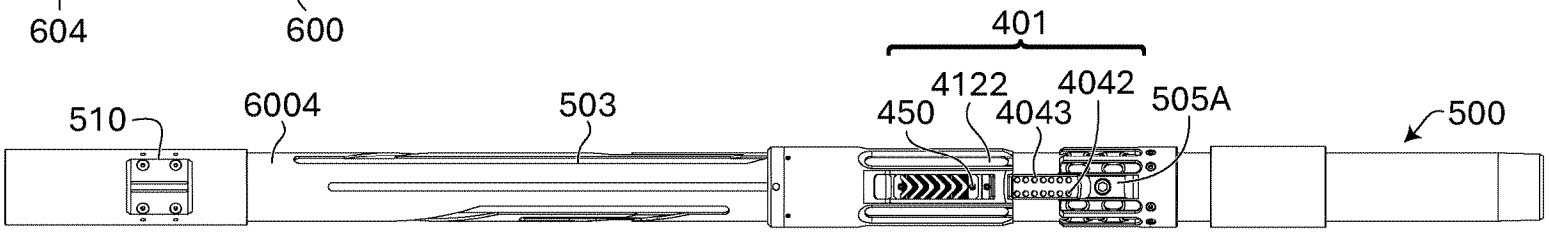
FIG. 29 is a top plan view of the anchoring assembly illustrated in FIG. 28.
Figure 30:
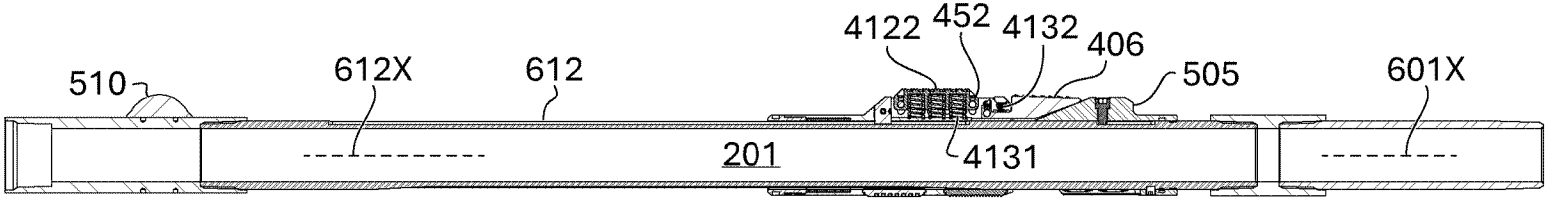
FIG. 30 is a sectional side view of the anchoring assembly illustrated in FIG. 28.
Figure 31:
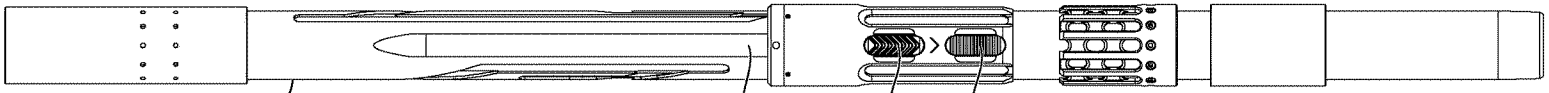
FIG. 31 is a bottom plan view of the anchoring assembly illustrated in FIG. 28.

As described above, in some embodiments, for example, the actuator tool 500 defines a recessed track 520 (see FIG. 21D, FIG. 27, and FIG. 31). The recessed track 520 is configured for receiving emplacement of the cavity-retained anchor 420 such that the cavity-retained anchor 420 is disposed in a retracted positon (i.e. in an anchoring ineffective state). The anchoring tool 400 and the actuator tool 500 are co-operatively configured such that, with the exception of a configuration of the anchoring assembly, whereby the guide pins 418 are disposed in the terminus 5023, the cavity-retained anchor 420 is disposed within the recessed track 520, such that the anchor 420 is disposed in the retracted position (i.e. in the anchoring ineffective state) for all other configurations of the anchoring assembly 300. Amongst other things, this is for mitigating unnecessary contact between the actuator 420 and the wellbore string 104 during this displacement. While travelling across the inclined surface 505B, the inclined surface 505B urges the actuation of the anchor 420, with effect that the anchor 420 becomes engaged to the wellbore string 104.

Referring to FIGS. 31 and 32, in those embodiments where the drag block configuration includes the cavity-retained drag block 4121, in some of these embodiments, for example, the recessed track 520 (see FIG. 26) and the cavity-retained drag block 4121 co-operate for establishing retracted and extended positions of the drag block 4121 relative to the wellbore string 104, and thereby also determining whether the drag block/casing scraper 4121 is positioned for effecting conditioning (e.g. scraping) of the wellbore string 104. The anchoring tool 400 and the actuator tool 500 are co-operatively configured such that, during the run-in-hole mode (i.e. when the guide pins are disposed within the terminus 5021), the drag block/casing scraper 4121 is urged by the inclined surface 505B (delete portion 521) into an extended position for effecting conditioning (e.g. scraping) of the wellbore string 104. The anchoring tool 400 and the actuator tool 500 are co-operatively configured such that, during the anchoring mode (i.e. when the guide pins 418 are disposed within the terminus 5023), the drag block/casing scraper 4121 is disposed in a retracted position for mitigating interference with the anchoring of the anchoring assembly 300 to the wellbore string 104.

In some embodiments, for example, the anchoring tool 400 is retained to the actuator tool 500 for preventing angular displacement of the anchoring tool 400 (including the anchor configuration 402) relative to the central longitudinal axis of the flow conductor 200 (and, in this respect, the central longitudinal axis of the actuator tool mount 602). In this respect, in some embodiments, for example, a key extends from the carrier 450, and a corresponding track 606 is defined within the outermost surface 604 of the actuator tool mount 602, and is disposed in parallel relationship with the central longitudinal axis of the flow conductor 200 (and, in this respect, the central longitudinal axis of the actuator tool mount 602). In this respect, the carrier 450 keys into the track 606. During displacement of the anchoring tool 400 relative to the actuator tool 500, the key 452 travels through the track 606. The key 452 and the track 606 are co-operatively configured such that the key 452 (and, therefore, the anchoring tool 400, including the anchor configuration) is displaceable, relative to the actuator tool 500, along the track 606, and such that angular displacement of the key 452, relative to the central longitudinal axis of the flow conductor 200 (and, in this respect, the central longitudinal axis of the actuator tool mount 602), is prevented. In some embodiments, for example, the track 606 is a recess defined within the outermost surface 604 of the actuator tool mount 602.

The preceding discussion provides many example embodiments. Although each embodiment represents a single combination of inventive elements, other examples may include all suitable combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be examples only. The invention is defined by the appended claims.

The invention claimed is:

1. An anchoring assembly configured for integration within a flow conductor that is emplaceable within a wellbore string, that is disposed within a wellbore that extends into a subterranean formation, wherein the anchoring assembly is transitionable from an anchoring ineffective state to an anchoring effective state for effecting anchoring of the flow conductor to the wellbore string, comprising:

an anchoring tool including:

an anchoring tool mount; and an anchor configuration coupled to the anchoring tool mount;

wherein:

the transitioning includes displacement of the anchor configuration, outwardly relative to the central longitudinal axis of the anchoring tool mount, with effect that:

the anchoring configuration becomes disposed further outwardly, relative to the central longitudinal axis of the anchoring assembly, than in the anchoring-ineffective state; and the anchor configuration becomes engaged to the wellbore string such that:

the anchor configuration is engaged to the wellbore string; and the anchoring of the flow conductor to the wellbore string is established; and the anchoring configuration includes at least one wedge-actuatable anchor, and each one of the at least one wedge-actuatable anchor, independently, includes a rocker, such that the engagement of the anchor configuration to the wellbore string includes an engagement of the at least one wedge-actuatable anchor to the wellbore string, wherein, for each one of the at least one wedge-actuatable anchor, independently, the engagement of the wedge-actuatable anchor to the wellbore string is over an interfacial area that is defined by a total axial length of at least two (2) inches.

2. The anchoring assembly as claimed in claim 1;

wherein:

the engagement, between the anchor configuration and the wellbore string is a flush engagement.

3. An anchoring assembly configured for integration within a flow conductor that is emplaceable within a wellbore string, that is disposed within a wellbore that extends into a subterranean formation, wherein the anchoring assembly is transitionable from an anchoring ineffective state to an anchoring effective state for effecting anchoring of the flow conductor to the wellbore string, comprising:

an anchoring tool including:

an anchoring tool mount, including an outermost surface;

an anchor configuration coupled to the anchoring tool mount; and a spacer extending outwardly from the outermost surface of the anchoring tool mount;

wherein:

the anchoring assembly is co-operable with the wellbore string such that, while the flow conductor is established and disposed within the wellbore string:

the transitioning includes displacement of the anchor configuration, outwardly relative to the central longitudinal axis of the anchoring tool mount, with effect that:

the anchoring configuration becomes disposed further outwardly, relative to the central longitudinal axis of the anchoring tool mount, than in the anchoring-ineffective state; and the anchor configuration becomes engaged to the wellbore string such that the anchoring of the flow conductor to the wellbore string is established; and the anchoring assembly becomes emplaced eccentrically relative to the central longitudinal axis of the wellbore string;

and the anchor configuration and the spacer are co-operable with the wellbore string such that, while the anchoring assembly is integrated within the flow conductor, that is disposed within the wellbore string, and the anchoring assembly is disposed in the anchoring-effective state, displacement, of the anchoring tool mount, relative to the central longitudinal axis of the wellbore string, being urged by application of a tensile force to the flow conductor in the uphole direction, and which is effective to defeat the anchoring, is resisted by the spacer.

4. The anchoring assembly as claimed in claim 3;

wherein:

the co-operation of the anchor configuration and the spacer, with the wellbore string, is such that the wellbore string interferes with outwardly displacement of the spacer relative to the central longitudinal axis of the wellbore string.

5. The anchoring assembly as claimed in claim 3;

wherein:

the spacer extends outwardly from an outermost surface of the anchoring assembly along an axis that is perpendicular to the central longitudinal axis of the anchoring assembly, by a distance of at least 0.5 of an inch.

6. The anchoring assembly as claimed in claim 3;

wherein:

the spacer is spaced apart from the anchoring configuration by a total axial distance of at least 20 inches.

7. An anchoring assembly configured for integration within a flow conductor that is emplaceable within a wellbore string, that is disposed within a wellbore that extends into a subterranean formation, wherein the anchoring assembly is transitionable from an anchoring ineffective state to an anchoring effective state for effecting anchoring of the flow conductor to the wellbore string, comprising:

an anchoring tool including:

an anchor configuration; and a drag block configuration;

wherein:

the anchor configuration and the drag block configuration are co-operatively configured such that there is an absence of resistance, to an actuation of the transitioning of the anchor configuration, by a biasing force configuration which is biasing the drag block configuration into the contact engagement with the wellbore string;

the anchoring configuration includes at least one wedge-actuatable anchor, wherein the actuation is with effect that, for each one of the at least one wedge-actuatable anchor, independently, the wedge-actuatable anchor becomes engaged to the wellbore string, wherein the actuation is urged by a respective wedge while the wedge, that is respective to the wedge-actuatable anchor, is being displaced in an uphole direction, relative to the wedge-actuatable anchor, while engaged to the wedge-actuatable anchor; and the drag block configuration includes, for each one of the at least one wedge-actuatable anchor, independently, a respective drag block for resisting movement of the wedge-actuatable anchor such that the drag block, that is respective to the wedge-actuatable anchor, is co-operable with the wedge for establishing the displacement of the wedge, relative to the wedge-actuatable anchor, while the wedge is being moved in the uphole direction.

8. The anchoring assembly as claimed in claim 7; wherein:

the drag block configuration is biased into the contact engagement with a respective biasing configuration, and the anchor is biased to retraction from the wellbore string with a respective biasing configuration, and the ratio of the biasing force of the biasing configuration, that is respective to the drag block configuration, to the biasing force of the biasing configuration, that is respective to the anchor, is greater than 5:1.

9. The anchoring assembly as claimed in claim 7; wherein:

for each one of the anchors, independently, the anchor and the drag block, that is respective to anchor, are aligned along a longitudinal axis that is parallel to the longitudinal axis of the wellbore string, and spaced apart by a minimum distance less than five (5) feet.

10. An anchoring assembly configured for integration within a flow conductor that is emplaceable within a wellbore string, that is disposed within a wellbore that extends into a subterranean formation, wherein the anchoring assembly is transitionable from an anchoring ineffective state to an anchoring effective state for effecting anchoring of the flow conductor to the wellbore string, comprising:

an anchoring tool including:

an anchoring tool mount, including an outermost surface;

an anchor configuration coupled to the anchoring tool mount; and an anchoring tool channel configuration that is recessed within the outermost surface of the anchoring tool mount;

wherein:

the anchoring tool channel configuration is disposed, relative to the anchor configuration, in an alignment which is effective for conducting reservoir fluid past the anchor configuration;

the anchoring tool channel configuration is defined by a plurality of anchoring tool channels, which are recessed within the outermost surface, and angularly spaced relative to one another; and each one of the anchoring tool channels, independently, has a depth of at least 1/16 inch.

11. The anchoring assembly as claimed in claim 10; wherein:

each one of the anchoring tool channels, independently, has a length of at least three (3) inches.

12. The anchoring assembly as claimed in claim 10; wherein:

the transitioning includes displacement of the anchor configuration, outwardly relative to the central longitudinal axis of the anchoring tool mount, with effect that:

the anchoring configuration becomes disposed further outwardly, relative to the central longitudinal axis of the anchoring tool mount, than in the anchoring-ineffective state; and the anchor configuration becomes engaged to the wellbore string such that the anchoring of the flow conductor to the wellbore string is established.

13. The anchoring assembly as claimed in claim 10; further comprising:

an actuator tool including:

an actuator tool mount; and an inclined surface configuration that is coupled to the actuator tool mount;

wherein:

the anchoring tool and the actuator tool are co-operatively configured such that, while the flow conductor is established and disposed within the wellbore string, the transitioning is responsive to urging, of the outwardly displacement of the anchoring configuration, by the inclined surface configuration, that is responsive to application of a tensile force to the actuator tool.

14. The anchoring assembly as claimed in claim 10; wherein:

the cross-sectional flow area of the anchoring tool channel configuration is at least 1.275 square inches.

15. The anchoring assembly as claimed in claim 10; wherein:

the anchoring tool is co-operable with the wellbore string such that, within a cross-section which is traversed by: (i) a flow by area-compensated anchor configuration, and (ii) the anchoring tool channel configuration which is disposed in an alignment with the flow by area-compensated anchor configuration, the ratio of, (i) the cross-sectional flow area of the aligned anchoring tool channel configuration, to (ii) the cross-sectional area occupied by the anchoring tool 400, is at least 0.121.

* * * * *